US007726387B2

(12) United States Patent
Higashiyama

(10) Patent No.: US 7,726,387 B2
(45) Date of Patent: Jun. 1, 2010

(54) HEAT EXCHANGERS

(75) Inventor: Naohisa Higashiyama, Oyama (JP)

(73) Assignee: Showa Denko K.K., Tokyo (JP)

( * ) Notice: Subject to any disclaimer, the term of this patent is extended or adjusted under 35 U.S.C. 154(b) by 978 days.

(21) Appl. No.: 10/587,396

(22) PCT Filed: May 11, 2005

(86) PCT No.: PCT/JP2005/009007

§ 371 (c)(1),
(2), (4) Date: Jul. 27, 2006

(87) PCT Pub. No.: WO2005/108899

PCT Pub. Date: Nov. 17, 2005

(65) Prior Publication Data

US 2007/0158057 A1 Jul. 12, 2007

Related U.S. Application Data

(60) Provisional application No. 60/570,823, filed on May 14, 2004, provisional application No. 60/637,438, filed on Dec. 21, 2004.

(30) Foreign Application Priority Data

May 11, 2004 (JP) ..... 2004-140527
Nov. 17, 2004 (JP) ..... 2004-332637

(51) Int. Cl.
*F28F 9/22* (2006.01)
*F28D 1/053* (2006.01)

(52) U.S. Cl. ..... 165/144; 165/153; 165/174; 165/176

(58) Field of Classification Search ..... 165/174–176, 165/144, 153
See application file for complete search history.

(56) References Cited

U.S. PATENT DOCUMENTS 5,086,835 A * 2/1992 Shinmura ..... 165/144
5,622,219 A * 4/1997 Voss et al. ..... 165/144

(Continued)

FOREIGN PATENT DOCUMENTS

JP 04335996 A * 11/1992 ..... 165/176

(Continued)

OTHER PUBLICATIONS

U.S. Appl. No. 11/813,561, filed Jul. 9, 2007, Higashiyama.

*Primary Examiner*—Leonard R Leo
(74) *Attorney, Agent, or Firm*—Oblon, Spivak, McClelland, Maier & Neustadt, L.L.P.

(57) ABSTRACT

An evaporator 1 comprises a heat exchange core 4 having heat exchange tubes 12 in groups 13, a refrigerant inlet header 5 and a refrigerant outlet header 6 which are arranged toward one end of each of the heat exchange tubes 12, and a refrigerant inflow header 9 and a refrigerant outflow header 11 which are arranged toward the other end of each heat exchange tube 12. The outflow header 11 has its interior divided by a flow dividing control wall 52 into two spaces 11*a*, 11*b* arranged one above the other. The inflow header 9 and the lower space 11*b* of the outflow header 11 are held in communication each at one end thereof. The control wall 52 has a plurality of refrigerant passing holes 53 arranged at a spacing longitudinally thereof.

32 Claims, 11 Drawing Sheets

U.S. PATENT DOCUMENTS

| | | | | |
|---|---|---|---|---|
| 5,934,367 | A * | 8/1999 | Shimmura et al. | 165/174 |
| 6,814,136 | B2 * | 11/2004 | Yi et al. | 165/174 |
| 7,066,243 | B2 * | 6/2006 | Horiuchi et al. | 165/176 |
| 2003/0066633 | A1 * | 4/2003 | Lee et al. | 165/144 |
| 2003/0188857 | A1 * | 10/2003 | Kawakubo et al. | 165/174 |
| 2003/0221819 | A1 * | 12/2003 | Jang | 165/173 |
| 2004/0211551 | A1 * | 10/2004 | Shinmura et al. | 165/175 |

FOREIGN PATENT DOCUMENTS

| | | |
|---|---|---|
| JP | 5 96784 | 12/1993 |
| JP | 5 346297 | 12/1993 |
| JP | 10 220989 | 8/1998 |
| JP | 2003 075024 | 3/2003 |

* cited by examiner

HEAT EXCHANGERS

CROSS REFERENCE TO RELATED APPLICATIONS

This application is an application filed under 35 U.S.C. §111 (a) claiming the benefit pursuant to 35 U.S.C. §119 (e) (1) of the filing dates of Provisional Applications No. 60/570,823 and No. 60/637,438 filed May 14, 2004 and Dec. 21, 2004, respectively, pursuant to 35 U.S.C. §111 (b).

TECHNICAL FIELD

The present invention relates to heat exchangers, more particularly to heat exchangers suitable to use, for example, as evaporators in motor vehicle air conditioners which are refrigeration cycles to be installed in motor vehicles.

The term "aluminum" as used herein and in the appended claims includes aluminum alloys in addition to pure aluminum. The downstream side (the direction indicated by the arrow X in FIGS. 1, 3, 5, 6, 8, 9 and 11) of the flow of air to be passed through air passage clearances between respective adjacent pairs of heat exchange tubes of the heat exchanger will be referred to herein and in the appended claims as "front," and the opposite side as "rear."

BACKGROUND ART

Heretofore in wide use as motor vehicle air conditioner evaporators are those of the so-called stacked plate type which comprise a plurality of flat hollow bodies arranged in parallel and each composed of a pair of dishlike plates facing toward each other and brazed to each other along peripheral edges thereof, and a louvered corrugated fin disposed between and brazed to each adjacent pair of flat hollow bodies. In recent years, however, it has been demanded to provide evaporators further reduced in size and weight and exhibiting higher performance.

To meet such a demand, the present applicant has already proposed an evaporator which comprise a heat exchange core composed of tube groups in the form of two rows arranged in parallel in the front-rear direction and each comprising a plurality of heat exchange tubes arranged at a spacing, a refrigerant inlet-outlet tank disposed at the upper end of the heat exchange core and a refrigerant turn tank disposed at the lower end of the heat exchange core, the refrigerant inlet-outlet tank having its interior divided by a partition into a refrigerant inlet header positioned on the front side and a refrigerant outlet header positioned on the rear side, the inlet header being provided with a refrigerant inlet at one end thereof, the outlet header being provided with a refrigerant outlet at one end thereof alongside the inlet, the refrigerant turn tank having its interior divided by a partition wall into a refrigerant inflow header positioned on the front side and a refrigerant outflow header positioned on the rear side, the partition wall of the refrigerant turn tank having a plurality of refrigerant passing holes formed therein and arranged longitudinally of the wall at a spacing, the heat exchange tubes of the front tube group having upper ends joined to the inlet header, the heat exchange tubes of the rear tube group having upper ends joined to the outlet header, the heat exchange tubes of the front tube group having lower ends joined to the inflow header, the heat exchange tubes of the rear tube group having lower ends joined to the outflow header. The refrigerant flowing into the inlet header of the inlet-outlet tank flows through the heat exchange tubes of the front tube group into the inflow header of the turn tank, then flows into the outflow header through the refrigerant passing holes in the partition wall and further flows into the outlet header of the inlet-outlet tank through the heat exchange tubes of the rear tube group (see the publication of JP-A NO. 2003-75024).

However, the present inventor has conducted extensive research and consequently found that it is difficult to further improve the performance of the evaporator disclosed in the above publication for the reason to be described below.

With the evaporator disclosed in the publication, it is likely that the refrigerant flowing into the inlet header will not dividedly uniformly flow into all the heat exchange tubes connected to the inlet header. As a result, the front heat exchange tube group of the heat exchange core becomes uneven in refrigerant distribution, consequently rendering the refrigerant flowing through the heat exchange tubes of the front group uneven in the distribution of temperatures (qualities of wet vapor) The refrigerant becoming uneven in temperature distribution flows through the inflow header and the outflow header and flows as it is into the heat exchange tubes of the rear group. Thus, the heat exchange tubes in the rear group become uneven in temperature distribution, and the unevenness becomes more pronounced. Accordingly, the air passing through the heat exchange core of the evaporator has varying temperatures at some portions thereof, and the evaporator fails to exhibit fully improved heat exchange performance. This problem becomes aggravated especially when the refrigerant flow rate involves variations or in the case where the flow of air through the heat exchange core varies at some locations.

An object of the present invention is to overcome the above problem and to provide a heat exchanger which is outstanding in heat exchange performance.

DISCLOSURE OF THE INVENTION

To fulfill the above object, the present invention comprises the following modes.

1) A heat exchanger comprising a refrigerant inlet header having a refrigerant inlet, a refrigerant outlet header positioned in the rear of the inlet header and having a refrigerant outlet, and a refrigerant circulating passage for causing the inlet header to communicate with the outlet header therethrough, the circulating passage comprising at least two intermediate headers and a plurality of heat exchange tubes for causing the inlet header and the outlet header to communicate with all the intermediate headers therethrough, the intermediate headers including a refrigerant inflow intermediate header and a refrigerant outflow intermediate header juxtaposed in a front-rear direction, the inflow intermediate header and the outflow intermediate header being held in communication each at one end thereof.

2) A heat exchanger according to par. 1) which comprises a heat exchange core composed of tube groups in the form of a plurality of rows arranged in the front-rear direction, each of the tube groups comprising a plurality of heat exchange tubes arranged at a spacing, a refrigerant inlet header positioned toward one end of each of the heat exchange tubes and having joined thereto the heat exchange tubes of the tube group of at least one row, a refrigerant outlet header positioned toward said one end of each heat exchange tube and in the rear of the inlet header and having joined thereto the heat exchange tubes of the remaining tube group, a refrigerant inflow intermediate header positioned toward the other end of each heat exchange tube and having jointed thereto the heat exchange tubes joined to the inlet header, and a refrigerant outflow intermediate header positioned toward said other end of each heat exchange tube and in the rear of the inflow intermediate header and having joined thereto the heat exchange tubes joined to the outlet header.

3) A heat exchanger according to par. 2) wherein the outflow intermediate header is provided in interior thereof with first flow dividing control means for causing a refrigerant to dividedly flow into the heat exchange tubes joined to the outflow intermediate header uniformly.

4) A heat exchanger according to par. 3) wherein the first flow dividing control means comprises a first flow dividing control wall having a plurality of refrigerant passing holes for dividing the interior of the outflow intermediate header into first and second two spaces arranged one above the other, the inflow intermediate header and the first space of the outflow intermediate header being held in communication each at one end of the header, and the heat exchange tubes joined to the outflow intermediate header communicate with the second space.

5) A heat exchanger according to par. 4) wherein the refrigerant passing holes formed in the first flow dividing control wall are arranged at a spacing longitudinally thereof.

6) A heat exchanger according to par. 5) wherein the spacing between each adjacent pair of refrigerant passing holes gradually increases, as the control wall extends away from said one end of the header where the inflow intermediate header and the outflow intermediate header are held in communication.

7) A heat exchanger according to par. 5) wherein respective adjacent pairs of refrigerant passing holes are equal in spacing.

8) A heat exchanger according to par. 5) wherein the refrigerant passing holes are formed in a portion of the first flow dividing control to the rear of a midportion thereof with respect to the front-rear direction.

9) A heat exchanger according to par. 4) wherein the inflow intermediate header and the outflow intermediate header are provided by dividing a refrigerant turn tank into a front and a rear portion by separating means.

10) A heat exchanger according to par. 9) wherein the turn tank is provided at one end thereof with a communication member for holding the inflow intermediate header and the outflow intermediate header in communication therethrough.

11) A heat exchanger according to par. 9) wherein the turn tank comprises a first member having the heat exchange tubes joined thereto, a second member brazed to the first member at a portion thereof opposite to the heat exchange tubes, and two closing members brazed to respective opposite ends of the first and second members, the second member being integrally provided with the separating means and the first flow dividing control wall.

12) A heat exchanger according to par. 11) wherein one of the closing members has two through holes for respectively causing the inflow intermediate header and the first space of the outflow intermediate header in communication with the inflow intermediate header to communicate with outside therethrough, and is provided with a communication member brazed to an outer side thereof for holding the two through holes in communication therethrough.

13) A heat exchanger according to par. 12) wherein the closing member having the through holes is platelike and the communication member is a plate having the same shape and size as the platelike closing member when seen from one side, the communication member being provided with an outwardly bulging portion having an inside communication channel for holding the two through holes of the closing member in communication therethrough.

14) A heat exchanger according to par. 13) wherein the closing member having the through holes comprises a main body having a contour shaped in conformity with the cross sectional contour of the turn tank and a protrusion projecting from the main body toward the inlet header and the outlet header, and the outwardly bulging portion of the communication member is formed in corresponding relation with the main body and the protrusion of the closing member.

15) A heat exchanger according to par. 3) wherein the inlet header is provided in interior thereof with second flow dividing control means for causing the refrigerant to dividedly flow into the heat exchange tubes joined to the inlet header uniformly.

16) A heat exchanger according to par. 15) wherein the second flow dividing control means comprises a second flow dividing control wall having a plurality of refrigerant passing holes for dividing the interior of the inlet header into first and second two spaces arranged one above the other, the refrigerant inlet being in communication with the first space, and the heat exchange tubes joined to the inlet header communicate with the second space.

17) A heat exchanger according to par. 16) wherein the refrigerant passing holes formed in the second flow dividing control wall are arranged at a spacing longitudinally thereof and are smaller than the refrigerant passing holes in the first flow dividing control means.

18) A heat exchanger according to par. 15) wherein the outlet header is provided in interior thereof with third flow dividing control means for causing the refrigerant to dividedly flow into the heat exchange tubes joined to the outlet header uniformly.

19) A heat exchanger according to par. 18) wherein the third flow dividing control means comprises a third flow dividing control wall having refrigerant passing holes for dividing the interior of the outlet header into first and second two spaces arranged one above the other, the refrigerant outlet being in communication with the first space, and the heat exchange tubes joined to the outlet header communicate with the second space.

20) A heat exchanger according to par. 16) wherein the inlet header and the outlet header are provided by dividing a refrigerant inlet-outlet tank into a front and a rear portion by separating means.

21) A heat exchanger according to par. 20) wherein the inlet-outlet tank comprises a first member having the heat exchange tubes joined thereto, a second member brazed to the first member at a portion thereof opposite to the heat exchange tubes, and two closing members brazed to respective opposite ends of the first and second members, the second member being integrally provided with the separating means, the second flow dividing control wall, and a third flow dividing wall having refrigerant passing holes for dividing the interior of the outlet header into two spaces arranged one above the other.

22.) A heat exchanger according to par. 1) wherein the heat exchange tubes are flat and are arranged with their width pointing toward the front-rear direction and are 0.75 to 1.5 mm in height i.e., in the thickness of the tube.

23) A heat exchanger according to par. 22) wherein a fin is disposed between each adjacent pair of heat exchange tubes and is a corrugated fin comprising crest portions, furrow portions and flat connecting portions each interconnecting the crest portion and the furrow portion, the fin being 7.0 to 10.0 mm in height, i.e., in the straight distance from the crest portion to the furrow portion and 1.3 to 1.7 mm in fin pin, i.e., in the pitch of the connecting portions.

24) A heat exchanger according to par. 23) wherein the crest portion and the furrow portion of the corrugated fin each comprise a flat portion and a rounded portion provided at each of opposite sides of the flat portion and integral with the connecting portion, the rounded portion being up to 0.7 mm in radius of curvature.

25) A refrigeration cycle comprising a compressor, a condenser and an evaporator, the evaporator comprising a heat exchanger according to any one of pars. 1) to 24).

26) A vehicle having installed therein a refrigeration cycle according to par. 25) as an air conditioner.

With the heat exchanger according to pars. 1) and 2), the inflow intermediate header and the outflow intermediate header are held in communication each at one end thereof, so that the refrigerant flowing from the inlet header into the inflow intermediate header through the heat exchange tubes joined thereto thus flows into the inflow header upon turning to change its course at the end portion. Accordingly, when flowing into the outflow intermediate header from the inflow intermediate header upon turning, the refrigerant is entirely agitated, becomes uniform in temperature in its entirely and flows into all the heat exchange tubes joined to the outflow intermediate header and the outlet header, with the refrigerant temperature made uniform, even if the refrigerant is uneven in the distribution of temperatures (qualities of wet vapor) when flowing through all the heat exchange tubes joined to the inlet header and the inflow intermediate header because the refrigerant flowing into the inlet header fails to uniformly dividedly flow into all the tubes joined to the inlet header.

With heat exchanger according to par. 3), the outflow intermediate header is provided in its interior with first flow dividing control means for causing the refrigerant to dividedly flow into the heat exchange tubes joined to the outflow intermediate header uniformly. Accordingly, all the heat exchange tubes joined to the outflow intermediate header and the outlet header are made uniform in the quantities of refrigerant flowing therethrough. The air passing through the heat exchange core is also made uniform in temperature, enabling the heat exchanger to achieve an improved heat exchange efficiency. Even when the flow rate of the refrigerant involves variations or in the case where the air flow through the heat exchange core varies in velocity at some locations, the air passing through the core is rendered uniform in temperature.

With the heat exchanger according to pars. 4) to 8), the first flow dividing control means can be provided inside the outflow intermediate header relatively easily.

The heat exchanger according to par. 9) can be reduced in its entirety in the number of components.

With the heat exchanger according to par. 10), the inflow intermediate header can be made to communicate with the outflow intermediate header relatively easily.

With the heat exchanger according to par. 11), the separating means for the turn tank and the first flow dividing control wall are made integral with the second member and can therefore be provided with ease.

With the heat exchanger according to pars. 12) and 13), the inflow intermediate header and the outflow intermediate header can be held in communication relatively easily each at one end thereof.

With the heat exchanger according to par. 14), the communication channel inside the outwardly bulging portion of the communication member can be given a great channel area although the space available is limited.

With the heat exchanger according to par. 15), the inlet header is provided in its interior with second flow dividing control means for causing the refrigerant to uniformly dividedly flow into the heat exchange tubes joined to the inlet header. The refrigerant flowing into the inlet header can therefore be uniformly dividedly led into all the tubes jointed to the inlet header. This reduces the likelihood that the refrigerant flowing through all the heat exchange tubes joined to the inlet header and the inflow intermediate header will become uneven in temperature distribution.

With the heat exchanger according to pars. 16) and 17), the second flow dividing control means can be provided in the inlet header relatively easily.

With heat exchanger according to par. 18), the outlet header is provided in its interior with third flow dividing control means for causing the refrigerant to uniformly dividedly flow into the heat exchange tubes joined to the outlet header. This uniformalizes the divided flow of refrigerant from the outflow intermediate header into all the heat exchange tubes joined to the outflow intermediate header and the outlet header, further uniformalizing the divided flow of refrigerant from the inlet header into all the heat exchange tubes joined to the inlet header and the inflow intermediate header.

With the heat exchanger according to par. 19), the third flow dividing control means can be provided in the outlet header relatively easily.

The heat exchanger according to par. 20) can be reduced in its entirety in the number of components.

With the heat exchanger according to par. 21), the second member is integral with the separating means for the inlet-outlet tank, the second flow dividing control wall and the third flow dividing wall having refrigerant passing holes for dividing the interior of the outlet header into two spaces arranged one above the other, so that the separating means and the two control walls can be provided in the inlet-outlet tank easily.

With the heat exchanger according to par. 22), the heat exchange performance can be improved with an increase in the resistance to the flow of air suppressed to ensure a good balance between the two factors.

With the heat exchanger according to par. 23), the heat exchange performance can be improved with an increase in the resistance to the flow of air suppressed to ensure a good balance between the two factors.

BEST MODE OF CARRYING OUT THE INVENTION

An embodiment of the present invention will be described below with reference to the drawings.

In the following description, the upper and lower sides and left-hand and right-hand sides of FIGS. 1 and 2 will be referred to as "upper," "lower," "left" and "right," respectively.

Figure 1:
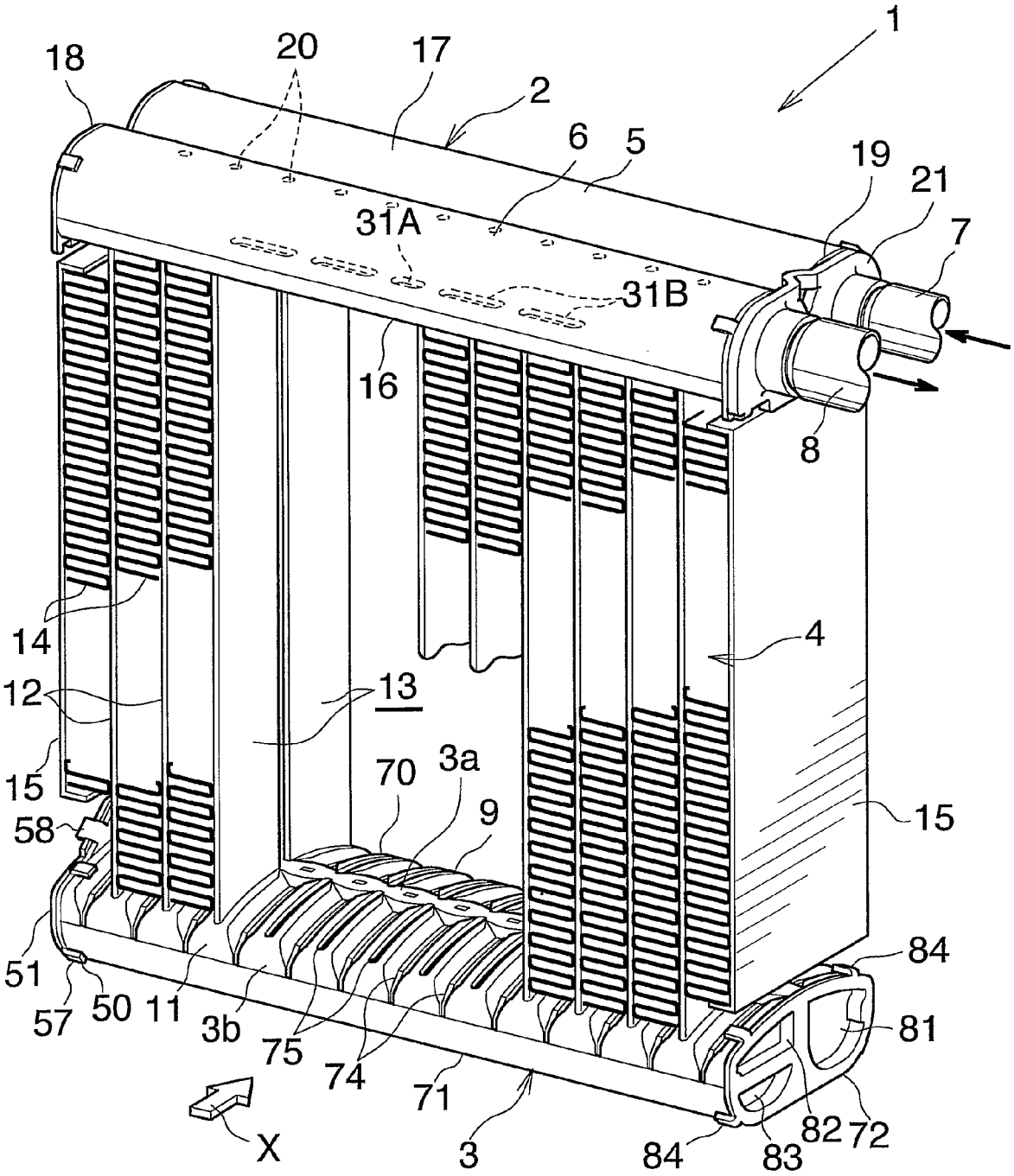
FIG. 1 is a perspective view partly broken away and showing the overall construction of a heat exchanger of the invention as adapted for use as an evaporator.
Figure 2:
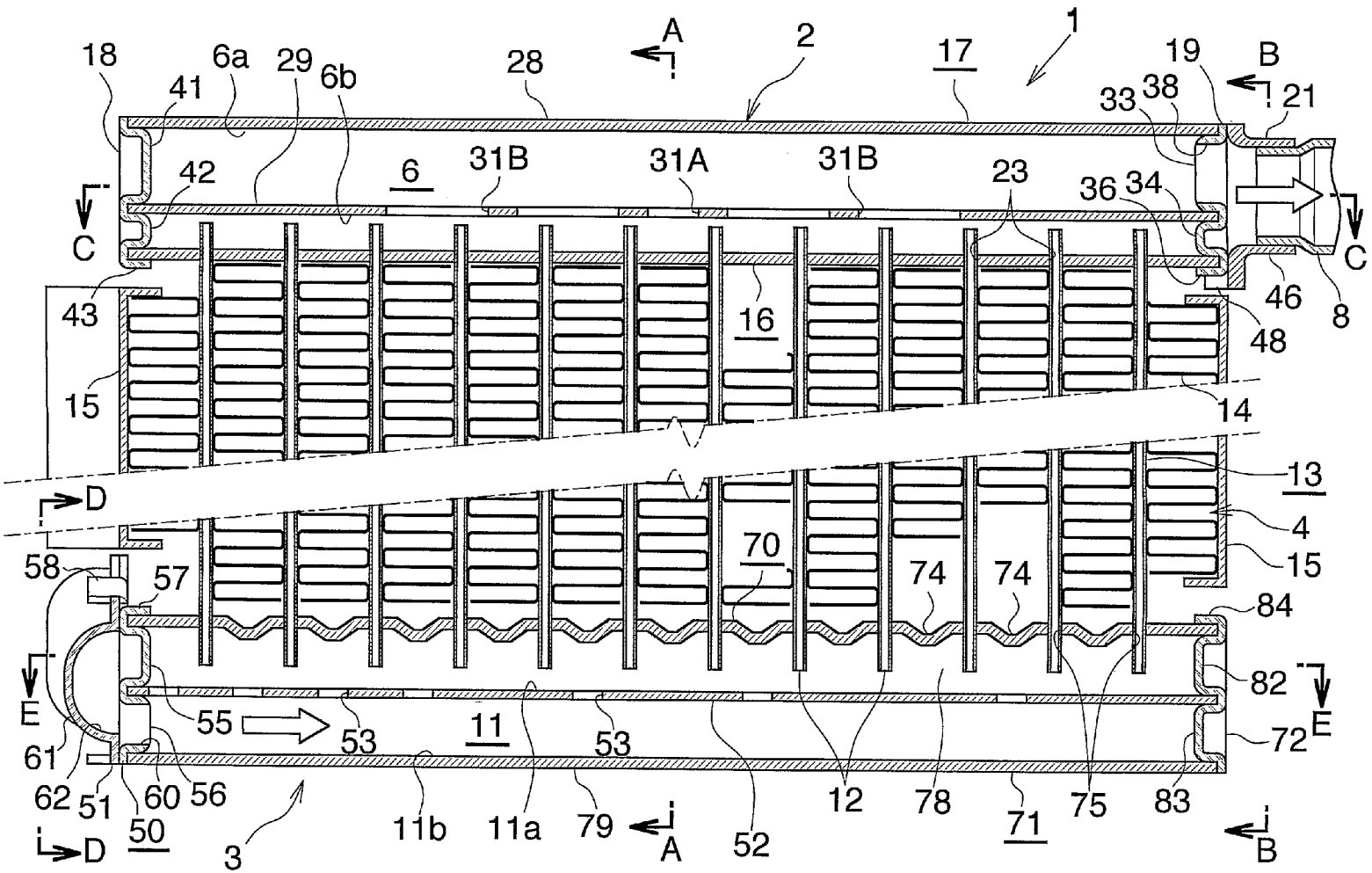
FIG. 2 is a view in vertical section showing the evaporator of FIG. 1 as it is seen from behind, with an intermediate portion omitted.
Figure 3:
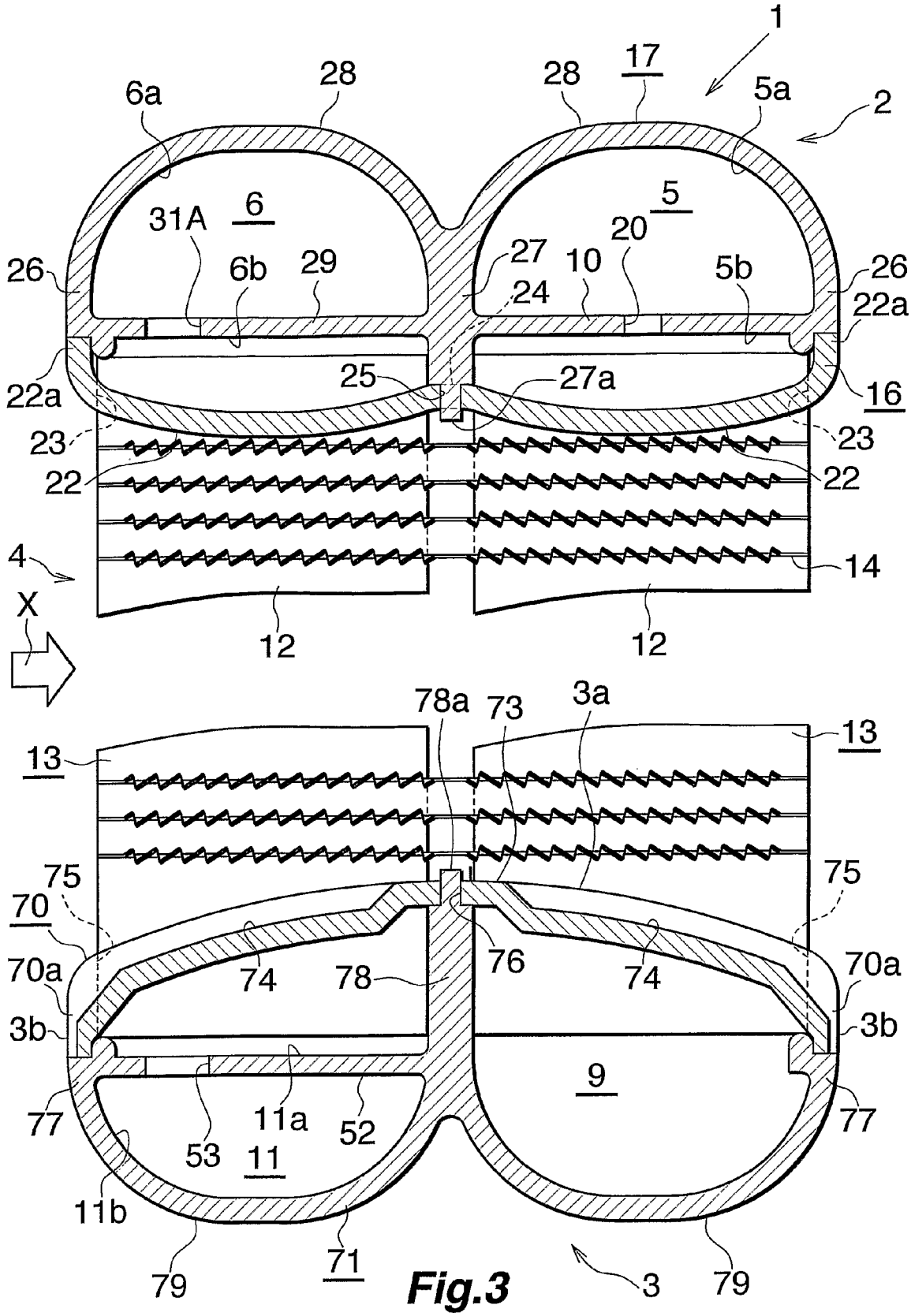
FIG. 3 is an enlarged fragmentary view in section taken along the line A-A in FIG. 2.
Figure 4:
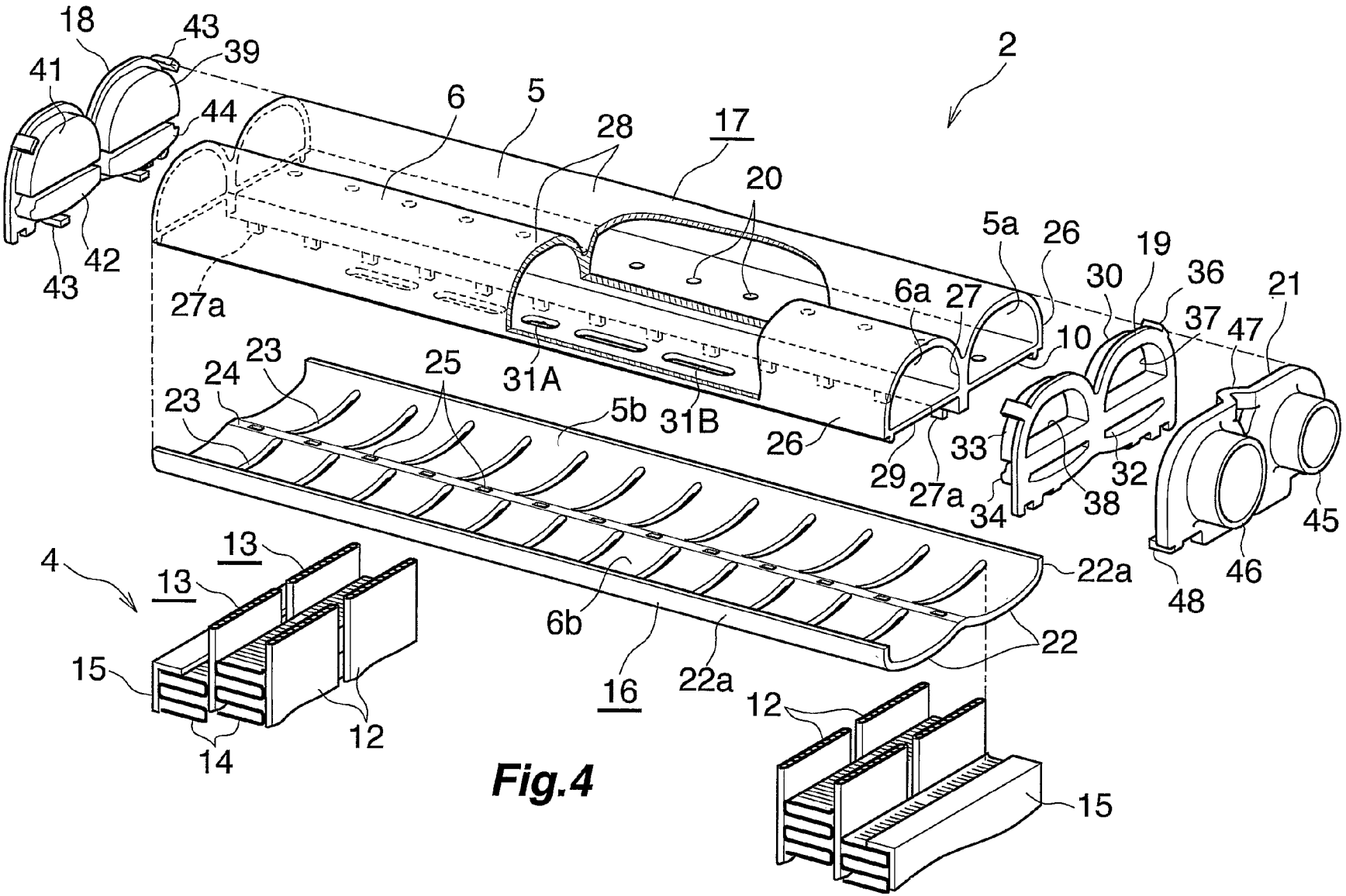
FIG. 4 is an exploded perspective view of a refrigerant inlet-outlet tank.
Figure 5:
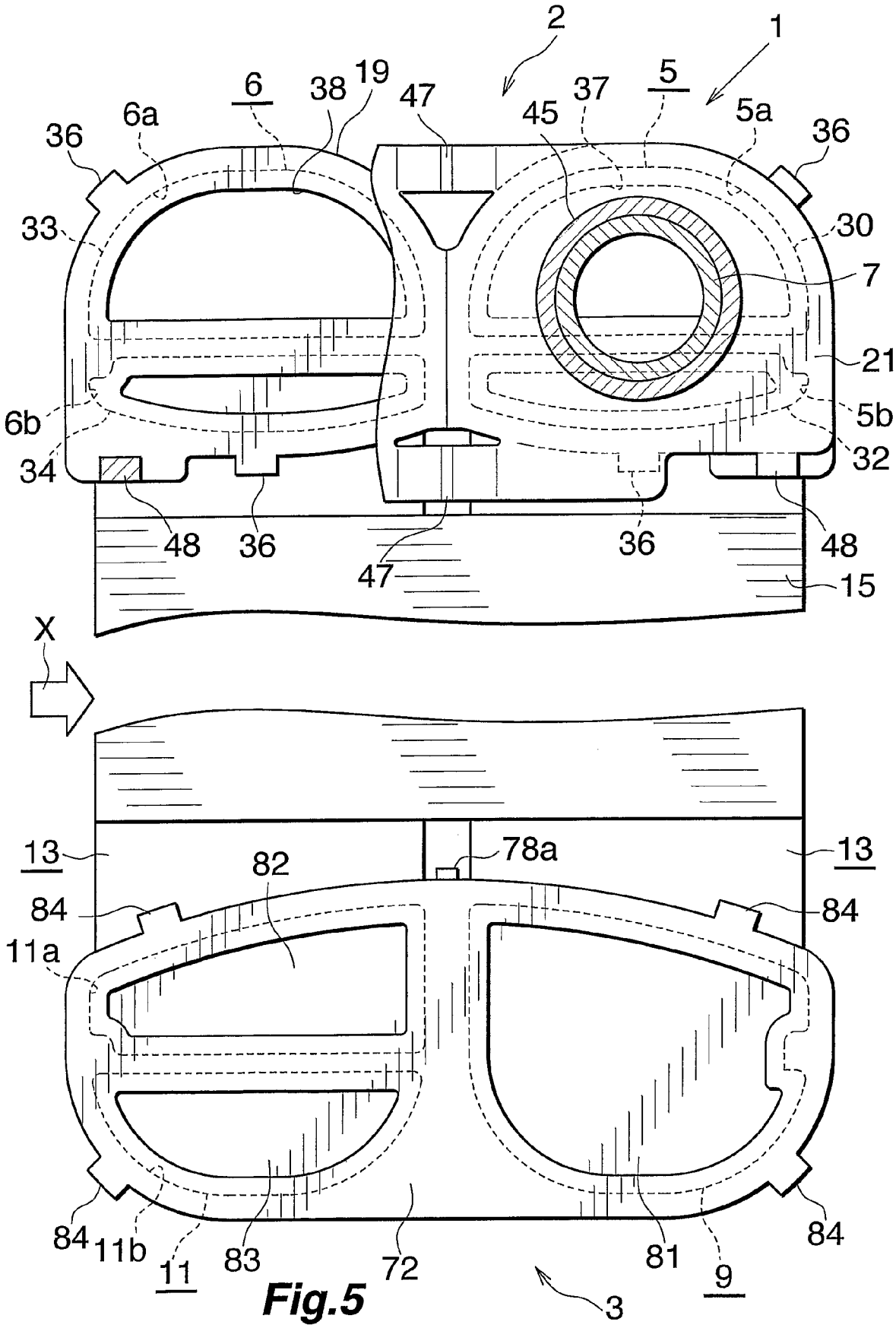
FIG. 5 is an enlarged fragmentary view in section taken along the line B-B in FIG. 2.
Figure 6:
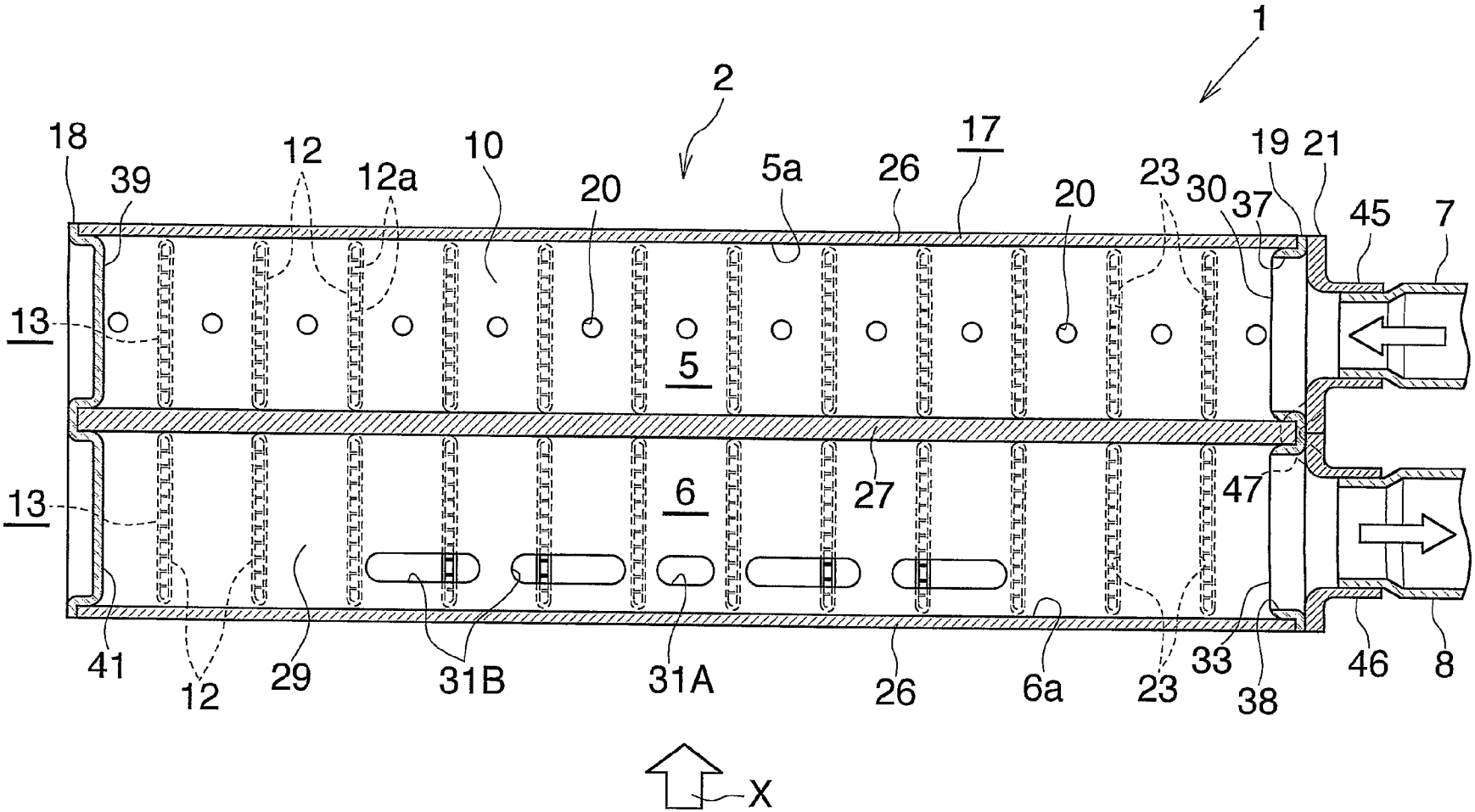
FIG. 6 is a view in section taken along the line C-C in FIG. 2.
Figure 7:
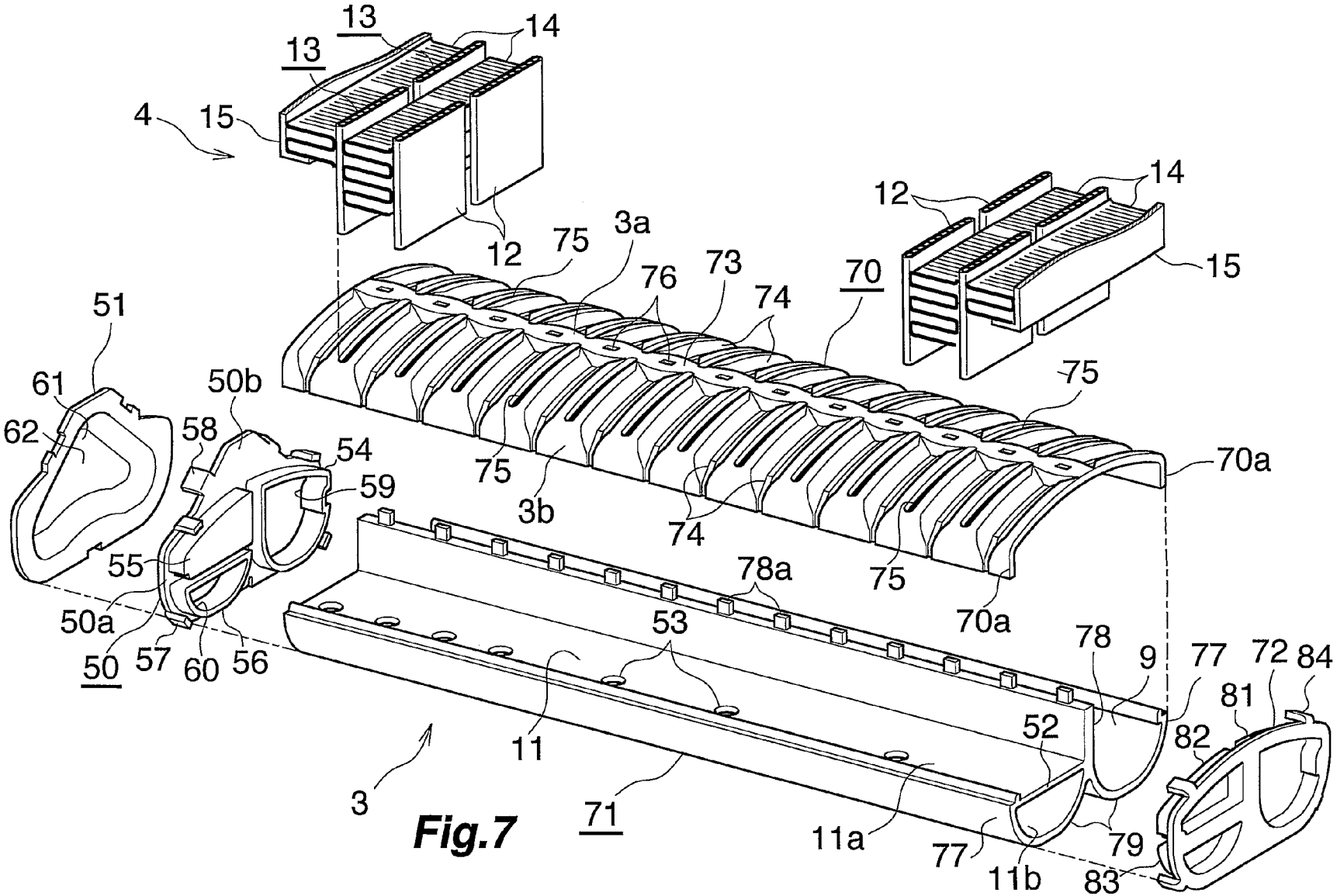
FIG. 7 is an exploded perspective view showing a refrigerant turn tank.
Figure 8:
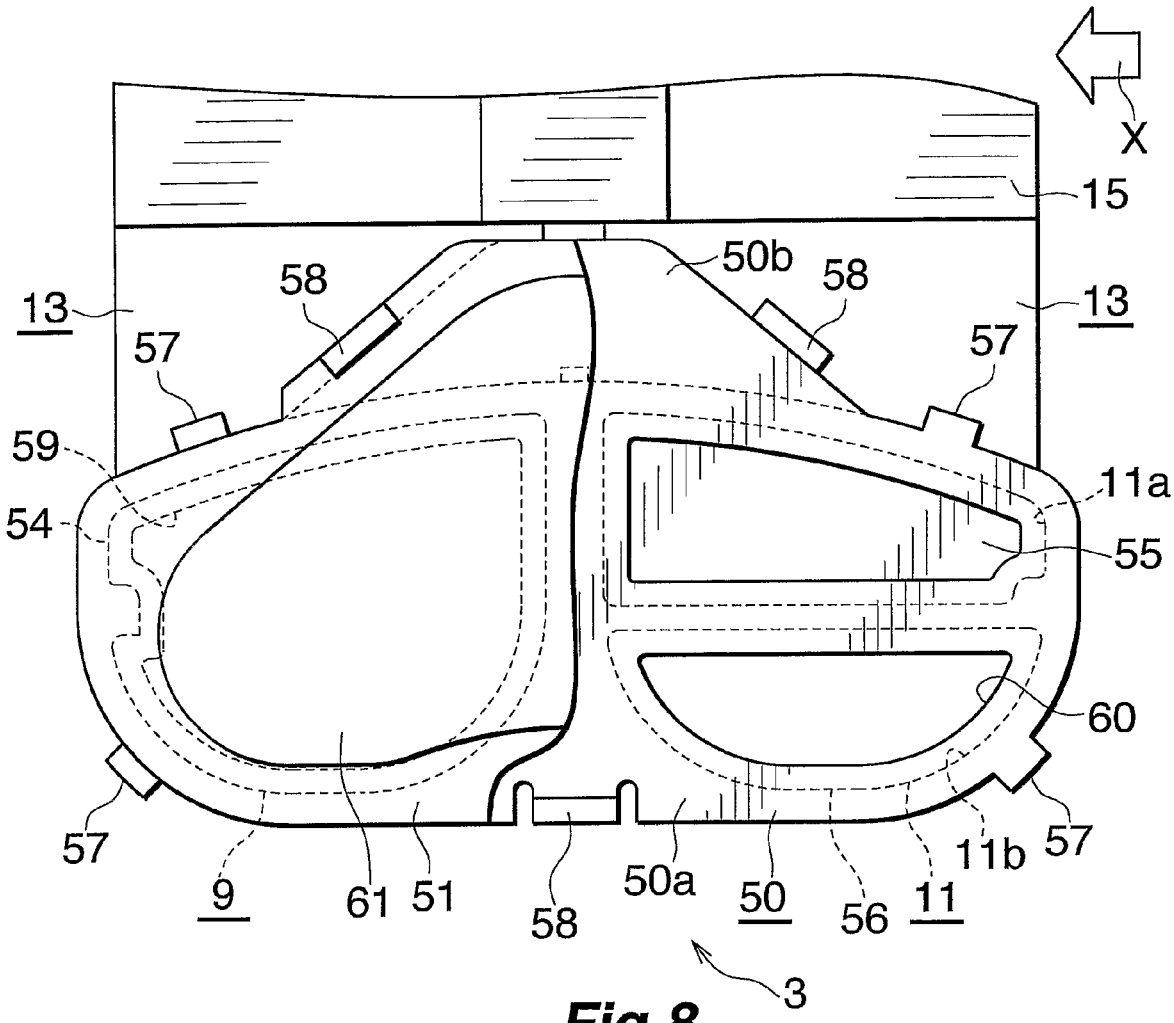
FIG. 8 is an enlarged view partly broken away and showing the evaporator as it is seen in the direction of arrows D-D in FIG. 2.
Figure 9:
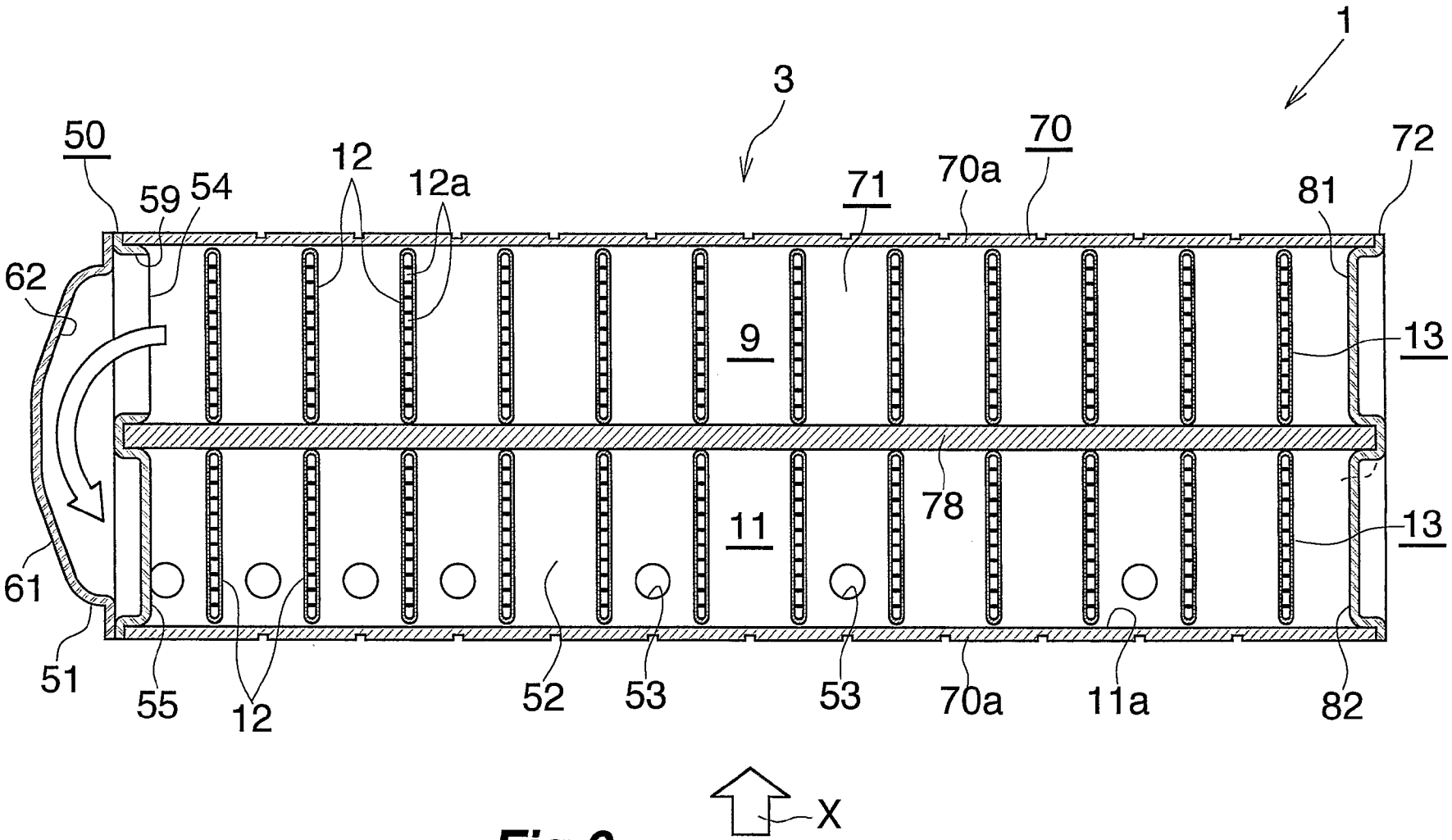
FIG. 9 is a view in section taken along the line E-E in FIG. 2.
Figure 10:
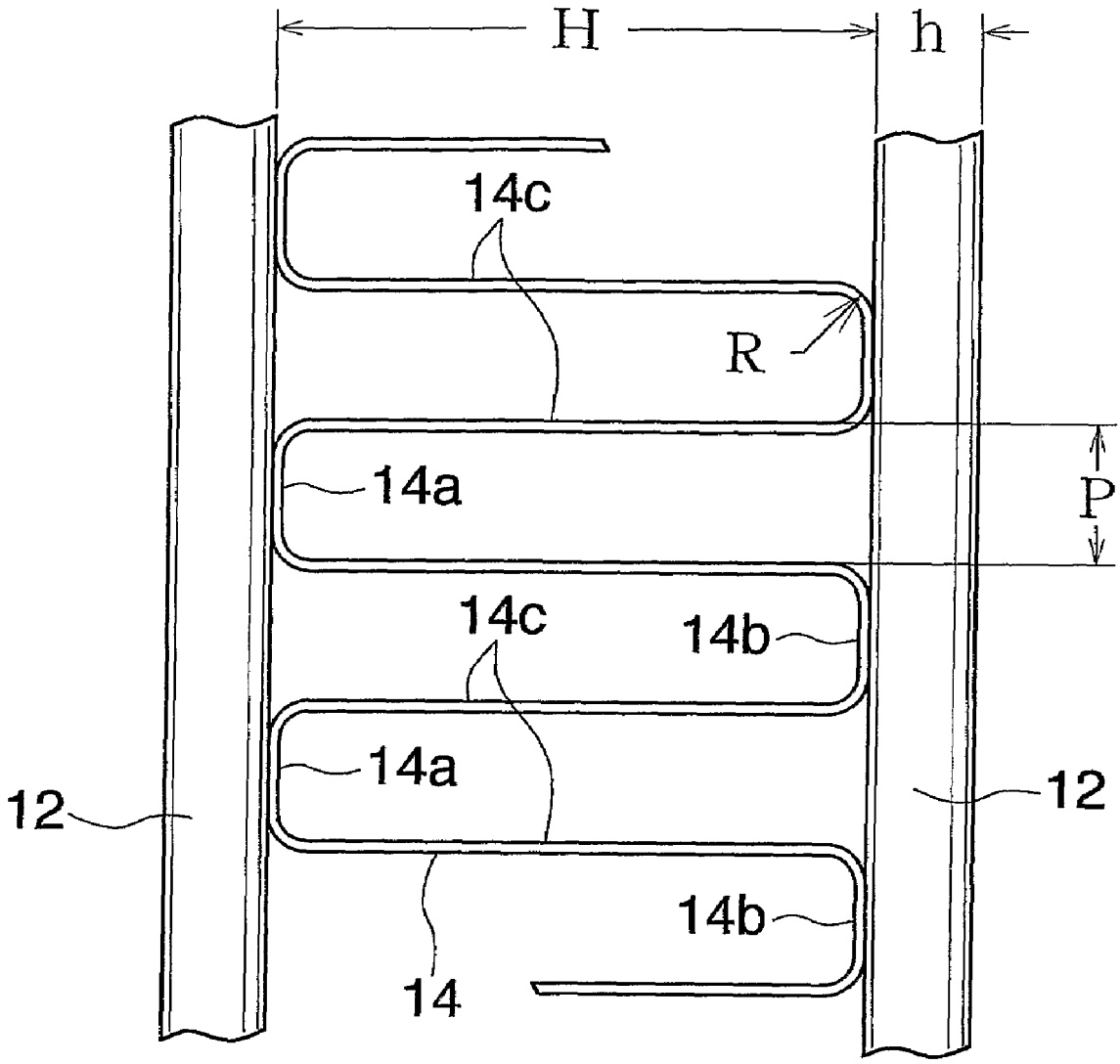
FIG. 10 is an enlarged view showing a portion of a heat exchange core of the evaporator shown in FIG. 1.
Figure 11:
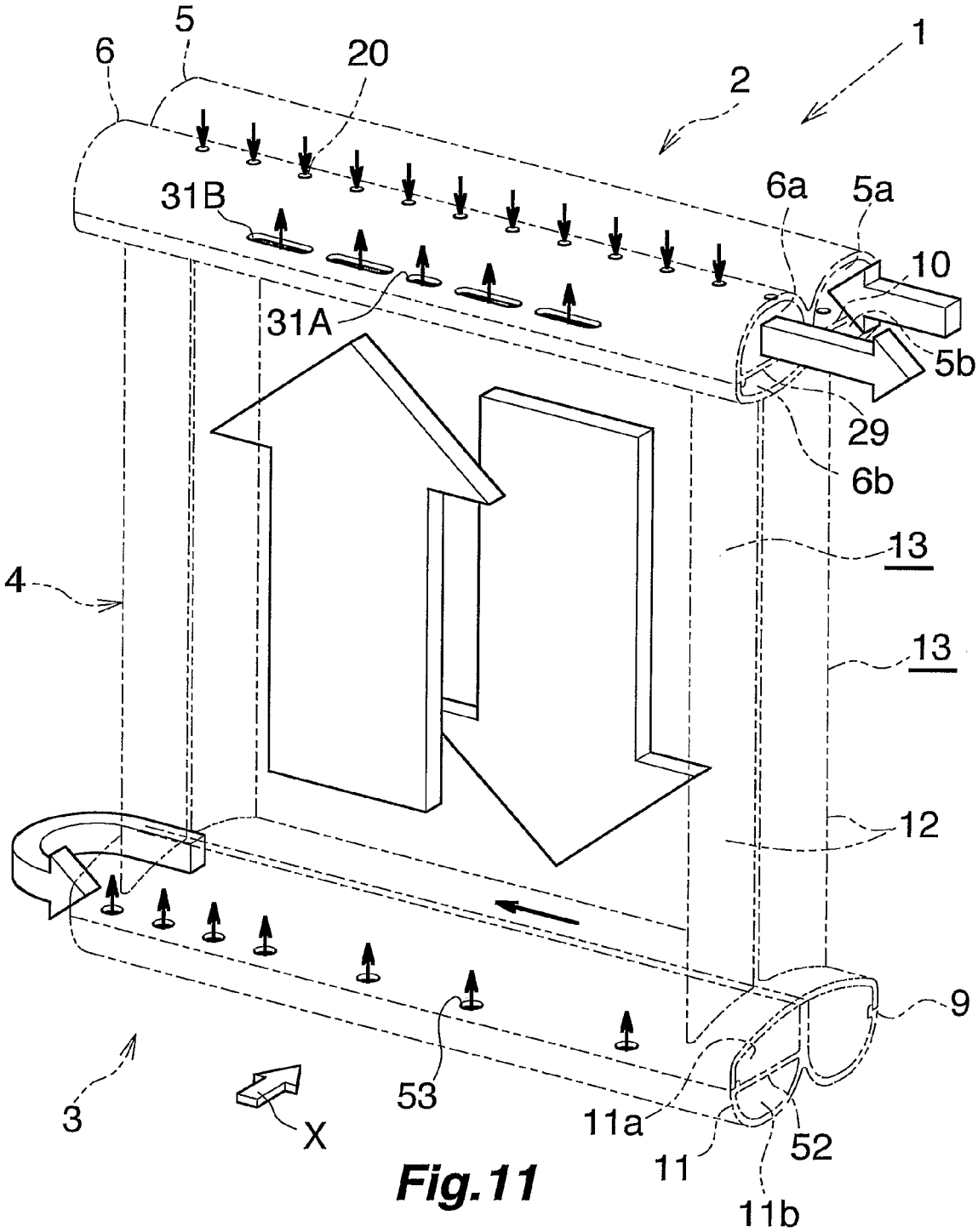
FIG. 11 is a diagram showing how a refrigerant flows through the evaporator shown in FIG. 1.

FIGS. 1 and 2 show the overall construction of an evaporator to which the heat exchanger of the invention is applied, FIGS. 3 to 10 show the constructions of main parts, and FIG. 11 shows how a refrigerant flows through the evaporator.

FIGS. 1 and 2 show an evaporator 1, which comprises a refrigerant inlet-outlet tank 2 of aluminum and a refrigerant turn tank 3 of aluminum which are arranged one above the other as spaced apart, and a heat exchange core 4 provided between the two tanks 2, 3.

The refrigerant inlet-outlet tank 2 comprises a refrigerant inlet header 5 positioned on the front side (the downstream side with respect to the direction of flow of air through the evaporator), and a refrigerant outlet header 6 positioned on the rear side (the upstream side with respect to the flow of air). A refrigerant inlet pipe 7 of aluminum is connected to the inlet header 5 of the tank 2, and a refrigerant outlet pipe 8 of aluminum to the outlet header 6 of the tank. The refrigerant turn tank 3 comprises a refrigerant inflow header 9 (refrigerant inflow intermediate header) positioned on the front side, and a refrigerant outflow header 11 (refrigerant outflow intermediate header) positioned on the rear side.

The heat exchange core 4 comprises tube groups 13 in the form of a plurality of rows, i.e., two rows in the present embodiment, as arranged in parallel in the front-rear direction, each tube group 13 comprising a plurality of heat exchange tubes 12 arranged in parallel in the left-right direction at a spacing. Corrugated fins 14 are arranged respectively in air passing clearances between respective adjacent pairs of heat exchange tubes 12 of tube groups 13 and also outside the heat exchange tubes 12 at the left and right opposite ends of the tube groups 13, and are each brazed to the heat exchange tube 9 adjacent thereto. An aluminum side plate 15 is disposed outside the corrugated fin 14 at each of the left and right ends and brazed to the fin 14. The heat exchange tubes 12 of the front tube group 13 have upper and lower ends joined to the inlet header 5 and the inflow header 9, respectively, and the heat exchange tubes 12 of the rear tube group 13 have upper and lower ends joined to the outlet header 6 and the outflow header 11, respectively.

With reference to FIGS. 3 to 6, the refrigerant inlet-outlet tank 2 comprises a platelike first member 16 made of an aluminum brazing sheet having a brazing material layer over opposite surfaces thereof and having the heat exchange tubes 12 joined thereto, a second member 17 of bare aluminum extrudate and covering the upper side of the first member 16, and aluminum caps 18, 19 (closing members) made of an aluminum brazing sheet having a brazing material layer over opposite surfaces there and joined to opposite ends of the two members 16, 17 for closing the respective opposite end openings. An aluminum joint plate 21 elongated in the front-rear direction is brazed to the outer surface of the cap 19 at the right end to extend across both the inlet header 5 and the outlet header 6. The refrigerant inlet and outlet pipes 7, 8 are joined to the joint plate 21.

The first member 16 has at each of the front and rear side portions thereof a curved portion 22 in the form of a circular arc of small curvature in cross section and bulging downward at its midportion. The curved portion 22 has a plurality of tube insertion slits 23 elongated in the front-rear direction and arranged at a spacing in the left-right, i.e., lateral, direction. Each corresponding pair of slits 23 in the front and rear curved portions 22 are in the same position with respect to the lateral direction. The front edge of the front curved portion 22 and the rear edge of the rear curved portion 22 are integrally provided with respective upstanding walls 22*a* extending over the entire length of the member 16. The first member 16 includes between the two curved portions 22 a flat portion 24 having a plurality of through holes 25 arranged at a spacing in the lateral direction.

The second member 17 is generally m-shaped in cross section and opened downward and comprises front and rear two walls 26 extending laterally, a partition wall 27 provided in the midportion between the two walls 26 and extending laterally as separating means for dividing the interior of the refrigerant inlet-outlet tank 2 into front and rear two spaces, and two generally circular-arc connecting walls 28 bulging upward, having a generally circular-arc cross section and integrally connecting the partition wall 27 to the respective front and rear walls 26 at their upper ends.

The front wall 26 and the partition wall 27 of the second member 17 are integrally interconnected at their lower ends over the entire length of the member 17 by a flow dividing control wall 10 (second flow dividing control wall) within the inlet header. At the same level as the flow dividing control wall 10, the rear wall 26 and the partition wall 27 of the second member 17 are integrally interconnected at their lower ends over the entire length of the member 17 by a flow dividing control wall 29 (third flow dividing control wall) within the outlet header. The control wall 10 in the inlet header is provided, in the midportion thereof with respect to the front-rear direction, with a plurality of circular refrigerating passing through holes 20 arranged laterally thereof at a spacing. The intervals between respective adjacent pairs of holes 20 are all equal. All the circular holes 20 are positioned between respective adjacent pairs of heat exchange tubes 12. The control wall 29 in the outlet header has refrigerant passing oblong through holes 31A, 31B elongated laterally, formed therein at a rear portion thereof other than the left and right end portions of the wall and arranged at a spacing laterally thereof. The oblong hole 31A in the midportion of the wall is smaller in length than the other oblong holes 31B and is positioned between an adjacent pair of heat exchange tubes 12. The partition wall 27 has a lower end projecting downward beyond the lower ends of the front and rear walls 26 and is integrally provided with a plurality of projections 27*a* projecting downward from the lower edge of the wall 27, arranged at a spacing in the lateral direction and fitted into the through holes 25 of the first member 16. The projections 27*a* are formed by cutting away specified portions of the partition wall 27. The flow dividing control wall 10 is integral with the front wall 26 and the partition wall 27, and the flow dividing control wall 29 is integral with the rear wall 26 and the partition wall 27 according to the present embodiment, whereas a wall separate from the front wall 26 and the partition wall 27, and a wall separate from the rear wall 26 and the partition wall 27 may be fixed in position to provide the respective control walls 10 and 29.

The second member 17 is made by extruding front and rear walls 26, partition wall 27, connecting walls 28 and two control walls 10, 29 in the form of an integral piece, forming refrigerant passing holes 20, 31A, 31B in the two control walls 10, 29 by press work and further cutting away portions of the partition wall 27 to make the projections 27*a*.

Each of the caps 18, 19 is in the form of a plate shaped generally in conformity with the cross sectional shape of the contour of the combination of the first and second members 16, 17, and is made from an aluminum brazing sheet having a brazing material layer over opposite surfaces thereof by press work. The right cap 19 has a front portion integrally provided with an upper leftward protrusion 30 to be fitted into the upper part of the inlet header 5 above the control wall 10 and with a lower leftward protrusion 32 positioned below and spaced apart from the protrusion 30 and to be fitted into the lower part of the header 5 under the wall 10. The right cap 19 has a rear portion integrally provided with an upper leftward protrusion 33 to be fitted into the upper part of the outlet header 6 above the control wall 29 and with a lower leftward protrusion 34 positioned below and spaced apart from the protrusion 33 and to be fitted into the lower part of the header 6 under the wall 29. The right cap 19 has engaging lugs 36 projecting leftward and formed integrally therewith on a circular-arc portion between the upper edge thereof and each of the front and rear side edges thereof and also on each of front and rear portions of the lower edge thereof. The upper leftward protrusion 30 of the right cap 19 at the front portion thereof has a bottom wall provided with a refrigerant inlet 37. The upper leftward protrusion 33 of the cap 19 at the rear portion thereof has a bottom wall provided with a refrigerant outlet 38.

The left cap 18 is symmetrical to the right cap 19 about a center line of the tank 2 extending transversely thereof. The left cap 18 has formed integrally therewith an upper rightward protrusion 39 fittable into the upper part of the inlet header 5 above the control wall 10, a lower rightward protrusion 44 fittable into the lower part of the inlet header 5 below the control wall 10, an upper rightward protrusion 41 fittable into the upper part of the outlet header 6 above the control wall 29, a lower rightward protrusion 42 fittable into the lower part of the header 6 below the control wall 29, and upper and lower engaging lugs 43 projecting rightward. No opening is formed in the bottom walls of the upper rightward protrusions 39, 41.

The joint plate 21 is made from a bare aluminum material by press work, and has a short cylindrical refrigerant inlet portion 45 communicating with the inlet 37 of the right cap 19, and a short cylindrical refrigerant outlet portion 46 communicating with the outlet 38 of the cap. The joint plate 21 has upper and lower edges each provided with a bent portion 47 projecting leftward and positioned between the inlet portion 45 and the outlet portion 46. The upper and lower bent portions 47 are in engagement with portions of the tank 2 between the inlet header 5 and the outlet header 6. The joint plate 21 further has engaging lugs 48 projecting leftward and formed integrally with the lower edge thereof respectively at its front and rear ends. The lugs 48 are engaged with the lower edge of the right cap 19.

The first and second members 16, 17 of the refrigerant inlet-outlet tank 2, the two caps 18, 19 and the joint plate 21 are brazed together in the following manner. The first and second members 16, 17 are brazed to each other utilizing the brazing material layer of the first member 16, with the projections 27*a* of the second member 17 inserted through the respective through holes 25 of the first member 16 in crimping engagement therewith and with the upper ends of the front and rear upstanding walls 22*a* of the first member 16 thereby engaged with the lower ends of the front and rear walls 26 of the second member 17. The two caps 18, 19 are brazed to the first and second members 16, 17 utilizing the brazing material layers of the caps 18, 19, with the upper protrusions 39, 30 of the front portions fitting in the upper space inside the two members 16, 17 forwardly of the partition wall 27 and above the control wall 10, with the lower protrusions 44, 32 of the front portions fitting in the lower space inside the two members 16, 17 forwardly of the partition wall 27 and below the control wall 10, with the upper protrusions 41, 33 of the rear portions fitting in the upper space inside the two members 16, 17 rearwardly of the partition wall 27 and above the control wall 29, with the lower protrusions 42, 34 of the rear portions fitting in the lower space rearwardly of the partition wall 27 and below the control wall 29, with the upper engaging lugs 43, 36 engaged with the connecting walls 28 of the second member 17, and with the lower engaging lugs 43, 36 engaged with the curved portions 22 of the first member 16. The joint plate 21 is brazed to the right cap 19 utilizing the brazing material layer of the cap 19, with the upper bent portion 47 engaged in the midportion, with respect to the front-rear direction, of the right cap 19 and in the portion of the second member 17 between the two connecting walls 28, with the lower bent portion 47 engaged with the midportion, with respect to the front-rear direction, of the right cap 19 and the flat portion 24 of the first member 16, and with the engaging lugs 48 engaged with the lower edge of the cap 19.

In this way, the refrigerant inlet-outlet tank 2 is made. The portion of the second member 17 forwardly of the partition wall 27 serves as the inlet header 2, and the portion of the member 17 rearward of the partition wall 27 as the outlet header 6. The inlet header 5 is divided by the flow dividing control wall 10 into upper and lower two spaces 5*a*, 5*b*, which are held in communication through the circular holes 20. The outlet header 6 is divided by the flow dividing control wall 29 into upper and lower two spaces 6*a*, 6*b*, which are held in communication by the oblong holes 31A, 31B. The refrigerant inlet 37 of the right cap 19 is in communication with the upper space 5*a* of the inlet header 5. The refrigerant outlet 38 is in communication with the upper space 6*a* of the outlet header 6. The refrigerant inlet portion 45 of the joint plate 21 communicates with the refrigerant inlet 37, and the refrigerant outlet portion 46 thereof communicates with the outlet 38. The upper space 5*a* of the inlet header 5 is a first space communicating with the inlet 37, and the lower space 5*b* thereof is a second space communicating with the heat exchange tubes 12 of the front group 13. The upper space 6*a* of the outlet header 6 is a first space communicating with the outlet 38, and the lower space 6¥*b* is a second space communicating with the heat exchange tubes 12 of the rear group 13.

With reference to FIG. 3 and FIGS. 7 to 9, the refrigerant turn tank3 comprises a platelike first member 70 made of aluminum brazing sheet having a brazing material layer over opposite surfaces thereof and having the heat exchange tubes 12 joined thereto, a second member 71 made of bare aluminum extrudate and covering the lower side of the first member 70, and aluminum caps 50, 72 (closing members) made of aluminum brazing sheet having a brazing material layer over opposite surfaces thereof for closing left and right opposite end openings. Brazed to the outer surface of the left cap 50 is a communication member 51 made of bare aluminum material, elongated in the front-rear direction and extending across both the inflow header 9 and the outflow header 11. The inflow header 9 and the outflow header 11 communicate with each other at their left ends through the communication member 51.

The refrigerant turn tank 3 has a top surface 3*a* which is in the form of a circular-arc in cross section in its entirety such that the midportion thereof with respect to the front-rear direction is the highest portion 73 which is gradually lowered toward the front and rear sides. The tank 3 is provided in its front and rear opposite side portions with grooves 74 extending from the front and rear opposite sides of the highest portion 73 of the top surface 3*a* to front and rear opposite side surfaces 3*b*, respectively, and arranged laterally at a spacing.

The first member 70 has a circular-arc cross section bulging upward at its midportion with respect to the front-rear direction and is provided with a depending wall 70*a* formed at each of the front and rear side edges thereof integrally therewith and extending over the entire length of the member 70. The upper surface of the first member 70 serves as the top surface 3*a* of the refrigerant turn tank 3, and the outer surface of the depending wall 70*a* as the front or rear side surface 3*b* of the tank 3. The grooves 74 are formed in each of the front and rear side portions of the first member 70 and extend from the highest portion 73 in the midportion of the member 70 with respect to the front-rear direction to the lower end of the depending wall 70*a*. In each of the front and rear side portions of the first member 70 other than the highest portion 73 in the midportion thereof, tube insertion slits 75 elongated in the front-rear direction are formed between respective adjacent pairs of grooves 74. Each corresponding pair of front and rear tube insertion slits 75 are in the same position with respect to the lateral direction. The first member 70 has a plurality of through holes 76 formed in the highest portion 73 and arranged laterally at a spacing. The depending walls 70*a*, grooves 74, tube insertions slits 75 and through holes 76 of the first member 70 are formed at the same time by making the member 70 from an aluminum brazing sheet by press work.

The second member 71 is generally w-shaped in cross section and opened upward, and comprises front and rear two walls 77 curved upwardly outwardly forward and rearward, respectively, and extending laterally, a vertical partition wall 78, provided at the midportion between the two walls 77, extending laterally and serving as separating means for dividing the interior of the refrigerant turn tank 3 into front and rear two spaces, and two connecting walls 79 integrally connecting the partition wall 78 to the respective front and rear walls 77 at their lower ends.

The upper end of the rear wall 77 of the second member 71 is integrally connected to the partition wall 78 by a flow dividing control wall 52 (first flow dividing control wall) within the outflow header 11 over the entire length of the member 71. The control wall 52 has a plurality of refrigerant passing circular through holes 53 formed in the portion thereof to the rear of its midportion with respect to the front-rear direction. The intervals between respective adjacent pairs of circular holes 53 gradually increase as the wall extends rightward from its left end, with the result that the number of holes 53 per unit length of the wall 52 decreases rightward. Incidentally, the intervals between respective adjacent pairs of holes 53 may be all equal. The circular holes 53 are larger than those 20 in the control wall 10 within the inlet header 5. The partition wall 78 has an upper end projecting upward beyond the upper ends of the front and rear walls 77 and is provided with a plurality of projections 78*a* projecting upward from the upper edge thereof integrally therewith, arranged laterally at a spacing and fitted into the respective through holes 76 in the first member 70. The projections 78*a* are formed by cutting away specified portions of the partition wall 78. Although the control wall 52 is made integral with the rear wall 77 and the partition wall 78, a wall separate from these walls 77, 78 may be fixed in position to provide the control wall 52 in the outflow header 11.

The second member 71 is made by extruding front and rear walls 77, partition wall 78, connecting walls 79 and flow dividing control wall 52 in the form of an integral piece, forming circular through holes 53 in the control wall 52 by press work and cutting away portions of the partition wall to make the projections 78*a*.

Each of the caps 50, 72 is in the form of a plate and made from an aluminum brazing sheet having a brazing material layer over opposite surfaces thereof by press work. The left cap 50 comprises a main body 50*a* shaped in conformity with the cross sectional shape of the contour of the combination of the first and second members 70, 71, and an upward protrusion 50*b* having a generally trapezoidal shape, integral with an intermediate portion, with respect to the front-rear direction, of the upper edge of the main body 50*a* and projecting upward beyond the first member 70. The main body 50*a* of the left cap 50 has a front portion integrally provided with a rightward protrusion 54 to be fitted into the inflow header 9, and a rear portion integrally provided with an upper rightward protrusion 55 to be fitted into the upper part of the outflow header 11 above the control wall 52 and with a lower rightward protrusion 56 positioned below and spaced apart from the protrusion 55 and to be fitted into the lower part of the header 11 under the wall 52. The main body 50*a* of the left cap 50 has engaging lugs 36 projecting rightward and formed on a circular-arc portion between the lower edge thereof and each of the front and rear side edges thereof and also on a portion of the upper edge thereof closer to each of the front and rear ends thereof. The left cap main body 50*a* further has engaging rugs 58 projecting leftward and formed on opposite slopes of the upward protrusion 50*b* thereof and on the lower edge thereof at its midportion with respect to the front-rear direction. Through holes 59, 60 are formed respectively in the bottom wall of the front rightward protrusion 54 of the left cap 50 and in the bottom wall of rear lower rightward protrusion 56 of the cap. The front hole 59 causes the interior of the inflow header 9 to communicate with the outside, and the rear hole 60 causes the lower space of the outflow header 11 below the control wall 52 to communicate with the outside.

The right cap 72 has a front portion integrally provided with a leftward protrusion 81 fittable into the inflow header 9, and a rear portion integrally provided with an upper leftward protrusion 82 to be fitted into the upper part of the outflow header 11 above the control wall 52 and with a lower leftward protrusion 83 positioned below and spaced apart from the protrusion 82 and to be fitted into the lower part of the header 11 under the wall 52. The right cap 72 has engaging lugs 84 projecting leftward and integrally formed on a circular-arc portion between the lower edge thereof and each of the front and rear side edges thereof and also on a portion of the upper edge thereof closer to each of the front and rear ends thereof. No through hole is formed in the rightward protrusion 81 or in the lower rightward protrusion 83.

The communication member 51 is made from a bare aluminum material by press work. When seen from the left side, the member 51 is in the form of a plate having the same size and shape as the left cap 50 and has a peripheral edge portion brazed to the outer surface of the left cap 50. The communication member 51 is provided with an outwardly bulging portion 61 for holding the two through holes 59, 60 of the left cap 50 in communication therethrough. The interior of the bulging portion 61 provides a communication channel 62 for holding the holes 59, 60 of the cap 50 in communication. The bulging portion 61 has an upper end positioned at the upper end of the upward protrusion 50*b* of the left cap 50. This gives a large area to the communication channel 62 although the space available is limited.

The first and second members 70, 71, the two caps 50, 72 and the communication member 51 of the turn tank 3 are brazed together in the following manner. The first and second members 70, 71 are brazed to each other utilizing the brazing material layer of the first member 70, with the projections 78*a* of the second member 71 inserted through the respective holes 76 in crimping engagement and with the lower ends of front and rear depending walls 70*a* of the first member 70 in engagement with the upper ends of front and rear walls 77 of the second member 71. The two caps 50, 72 are brazed to the first and second members 70, 71 using the brazing material layers of the caps 50, 72, with the front protrusions 54, 81 fitted in the space defined by the two members 70, 71 and positioned forwardly of the partition wall 78, with the rear upper protrusions 55, 82 fitted in the upper space defined by the two members 70, 71 and positioned rearwardly of the partition wall 78 and above the flow dividing control wall 52, with the rear lower protrusions 56, 83 fitted in the lower space defined by the two members 70, 71 and positioned rearwardly of the partition wall 78 and below the flow dividing control wall 52, with the upper engaging lugs 57, 84 engaged with the first member 70 and with the lower engaging lugs 57 engaged with the front and rear walls 77 of the second member 71. The communication member 51 is brazed to the left cap 50 utilizing the brazing material layer of the cap 50, with the engaging lugs 58 of the cap 50 in engagement with the communication member 51.

In this way, the refrigerant turn tank 3 is formed. The portion of the second member 71 forwardly of the partition wall 78 serves as the inflow header 9, and the portion thereof rearwardly of the partition wall 78 as the outflow header 11. The outflow header 11 is divided by the flow dividing control wall 52 into upper and lower two spaces 11*a*, 11*b*, which are held in communication through the circular refrigerant passing holes 53. The rear through hole 60 of the left cap 50 communicates with the lower space 11*b* of the outflow header 11. The interior of the inflow header 9 is held in communication with the lower space 11*b* of the outflow header 11 by way of the through holes 59, 60 of the left cap 50 and the communication channel 62 in the outwardly bulging portion 61 of the communication member 51. The lower space lib of the outflow header 11 is a first space communicating with the inflow header 9, and the upper space 11*a* is a second space communicating with the heat exchange tubes 12 of the rear tube group 13.

The heat exchange tubes 12 providing the front and rear tube groups 13 are each made of a bare material of aluminum extrudate. Each tube 12 is flat, has a large width in the front-rear direction and is provided in its interior with a plurality of refrigerant channels 12*a* extending longitudinally of the tube and arranged in parallel. The tube 12 has front and rear end walls outwardly bulging in a circular-arc form. The heat exchange tubes 12 of the front group 13 are in alignment with the corresponding tubes of the rear group with respect to the lateral direction. The tubes 12 have upper end portions inserted through the slits 23 in the first member 16 of the refrigerant inlet-outlet tank 2 and are brazed to the first member 16 utilizing the brazing material layer of the member 16. The tubes 12 have lower end portions inserted through the slits 75 in the first member 70 of the refrigerant turn tank 3 and are brazed to the first member 70 utilizing the brazing material layer of the member 70. The tubes 12 of the front group 13 communicate with the inlet header 5 and the inflow header 9, and the tubes 12 of the rear group 13 with the outlet header 6 and the outflow header 11.

Preferably, the heat exchange tube 12 is 0.75 to 1.5 mm in height h, i.e., in thickness in the lateral direction (see FIG. 10), 12 to 18 mm in width in the front-rear direction, 0.175 to 0.275 mm in the wall thickness of the peripheral wall thereof, 0.175 to 0.275 mm in the thickness of partition walls separating refrigerant channels 12*a* from one another, 0.5 to 3.0 mm in the pitch of partition walls, and 0.35 to 0.75 mm in the radius of curvature of the outer surfaces of the front and rear opposite end walls.

In place of the heat exchange tube 12 of aluminum extrudate, an electric resistance welded tube of aluminum may be used which has a plurality of refrigerant channels formed therein by inserting inner fins into the tube. Also usable is a tube made from a plate which is prepared from an aluminum brazing sheet having an aluminum brazing material layer over opposite surfaces thereof by rolling work and which comprises two flat wall forming portions joined by a connecting portion, a side wall forming portion formed on each flat wall forming portion integrally therewith and projecting from one side edge thereof opposite to the connecting portion, and a plurality of partition forming portions projecting from each flat wall forming portion integrally therewith and arranged at a spacing widthwise thereof. The tube is made by bending the plate into the shape of a hairpin at the connecting portion and brazing the side wall forming portions to each other in butting relation to form partition walls by the partition forming portions. The corrugated fins to be used in this case are those made from a bare aluminum material.

FIG. 10 shows a corrugated fin 14 made from an aluminum brazing sheet having a brazing material layer on opposite sides thereof by shaping the sheet into a wavy form. The fin comprises crest portions 14*a*, furrow portions 14*b* and flat horizontal connecting portions 14*c* each interconnecting the crest portion 14*a* and the furrow portion. The connecting portion 14*c* has a plurality of louvers arranged in the front-rear direction. The corrugated fin 14 is used in common for the front and rear heat exchange tubes. The width of the fin 14 in the front-rear direction is approximately equal to the distance from the front edge of the heat exchange tube 12 in the front tube group 13 to the rear edge of the corresponding heat exchange tube 12 in the rear tube group 13 (see FIG. 3). The crest portions 14*a* and the furrow portions 14*b* of the fin 14 are brazed to the heat exchange tubes 12 adjacent thereto. Instead of one corrugated fin serving for both the front and rear tube groups 13 in common, a corrugated fin may be provided between each adjacent pair of heat exchange tubes 12 of each tube group 13.

It is desired that the corrugated fin 14 be 7.0 mm to 10.0 mm in fin height H which is the straight distance from the crest portion 14*a* to the furrow portion 14*b*, and 1.3 to 1.8 mm in fin pitch P which is the pitch of connecting portions 14*c*. While the crest portion 14*a* and the furrow portion 14*b* of the corrugated fin 14 each comprise a flat portion brazed to the heat exchange tube 12 in intimate contact therewith, and a rounded portion provided at each of opposite sides of the flat portion and integral with the connecting portion 14*c*, the radius R of curvature of the rounded portion is preferably up to 0.7 mm.

The evaporator 1 is fabricated by tacking the components in combination and brazing all the components collectively.

Along with a compressor and a condenser, the evaporator 1 constitutes a refrigeration cycle, which is installed in vehicles, for example, in motor vehicles for use as an air conditioner.

With reference to FIG. 11 showing the evaporator 1 described, a two-layer refrigerant of vapor-liquid mixture phase flowing through a compressor, condenser and expansion valve enters the upper space 5*a* of the refrigerant inlet header 5 of the inlet-outlet tank 2 via the refrigerant inlet pipe 7, the refrigerant inlet portion 45 of the joint plate 21 and the refrigerant inlet 37 of the right cap 19, flows through the refrigerant passing circular holes 20 in the flow dividing control wall 10 within the inlet header into the lower space 5*b*, and dividedly flows into the refrigerant channels 12*a* of all the heat exchange tubes 12 of the front tube group 13.

At this time, the control wall 10 offers resistance to the flow of refrigerant, permitting the refrigerant to flow through all the circular holes 20 at uniform rates, so that the refrigerant flowing into the inlet header 5 dividedly flows into all the tubes 12 of the front tube group uniformly. This reduces the likelihood of the refrigerant flowing through all the tubes 12 in the front group 13 becoming uneven in temperature distribution.

The refrigerant flowing into the channels 12*a* of all the heat exchange tubes 12 flows down the channels 12*a*, ingresses into the refrigerant inflow header 9 of the refrigerant turn tank 3. The refrigerant in the header 9 flows leftward, further flows through the front through hole 59 of the left cap 50, the communication channel 62 inside the outwardly bulging portion 61 of the communication member 51 and the rear through hole 60 of the left cap 50, thereby changing its course to turn, and enters the lower space 11*b* of the outflow header 11.

Even if the refrigerant fails to dividedly flow into the heat exchange tubes 12 of the front group 13 fully uniformly and consequently becomes uneven in the distribution of temperatures (qualities of wet vapor) while flowing through all the tubes 12 of the front group 13, the refrigerant is entirely agitated and becomes uniform in temperature in its entirety when flowing from the inlet header 6 into the lower space 11*b* of the outflow header 11 upon turning.

The refrigerant entering the lower space 11*b* of the outflow header 11 flows rightward, flows into the upper space 11*a* through the refrigerant passing circular holes 53 in the flow dividing control wall 52 within the outflow header 11 and dividedly flows into the refrigerant channels 12*a* of all the heat exchange tubes 12 of the rear group 13.

At this time, a larger amount of refrigerant tends to flow in the lower space 11*b* of the header 11 toward the right end thereof, whereas the number of circular holes 53 per unit length of the wall 52 decreases toward the right end, so that the amount of refrigerant in the upper space 11*a* is made uniform over the entire length of the upper space 11*a*. Consequently, the refrigerant flows dividedly into all the tubes 12 of the rear group 13 uniformly. This reduces the likelihood of the refrigerant flowing through all the tubes 12 of the rear group 13 becoming uneven in temperature distribution.

The refrigerant entering the refrigerant channels 12*a* of the tubes 12 flows up the channels 12*a* upon changing its course, flows into the lower space 6*b* of the outlet header 6 and then flows into the upper space 6*a* through the refrigerant passing oblong holes 31A, 31B in the flow dividing control wall 29 within the outlet header 6. Since the control wall 29 offers resistance to the flow of refrigerant, the divided flows from the upper space 11*a* of the outflow header 11 into all the tubes 12 of the rear group 13 are made uniform, also permitting the refrigerant to flow from the lower space 5*b* of the inlet header 5 dividedly into all the tubes 12 of the front group 13 also uniformly. As a result, the refrigerant flows through all tubes 12 of the two groups 13 uniformly to give a uniform temperature distribution to the entire heat exchange core 4.

The refrigerant flowing into the upper space 6*a* of the outlet header 6 thereafter flows out of the evaporator via the refrigerant outlet 38 of the right cap 19, the outlet portion 46 of the joint plate 21 and the outlet pipe 8. While flowing through the refrigerant channels 12*a* of the heat exchange tubes 12 of the front tube group 13 and the refrigerant channels 12*a* of the heat exchange tubes 12 of the rear tube group 13, the refrigerant is subjected to heat exchange with the air flowing through the air passing clearances in the direction of arrow X shown in FIGS. 1 and 10 and flows out of the evaporator in a vapor phase.

At this time, water condensate is produced on the surfaces of the corrugated fins 14 to flow down the top surface 3*a* of the turn tank 3. The condensate flowing down the tank top surface 3*a* enters the grooves 74 by virtue of a capillary effect, flows through the grooves 74 and falls off the forwardly or rearwardly outer ends of the grooves 74 to below the turn tank 3. This prevents a large quantity of condensate from collecting between the top surface 3*a* of the turn tank 3 and the lower ends of the corrugated fins 14, consequently preventing the condensate from freezing due to the collection of large quantity of the condensate, whereby inefficient performance of the evaporator 1 is precluded.

One group 13 of heat exchange tubes is provided between the inlet header 5 and the inflow header 9 of the two tanks 2, 3, as well as between the outlet header 6 and the outflow header 11 thereof according to the foregoing embodiment, whereas this arrangement is not limitative; one or at least two groups 13 of heat exchange tubes may be provided between the inlet header 5 and the inflow header 9 of the two tanks 2, 3, as well as between the outlet header 6 and the outflow header 11 thereof. Although the inlet-outlet tank 2 is positioned above the turn tank 3 according to the above embodiment, the evaporator may be used with the turn tank 3 positioned above the inlet-outlet tank 2.

Although the heat exchanger of the invention is used as an evaporator according to the foregoing embodiment, this mode of embodiment not limitative.

The evaporator of the invention is used also as such in supercritical refrigeration cycles which comprise a compressor, gas cooler, evaporator, expansion valve serving as a pressure reducing device, accumulator serving as a vapor-liquid separator, and an intermediate heat exchanger for subjecting the refrigerant flowing out of the gas cooler and the refrigerant flowing out of the evaporator to heat exchange, and wherein $CO_2$ or like supercritical refrigerant is used. Such a supercritical refrigeration cycle is installed in vehicles, for example, in motor vehicles as an air conditioner.

INDUSTRIAL APPLICABILITY

The heat exchanger of the invention is suitable for use as an evaporator in motor vehicle air conditioners which are refrigeration cycles to be installed in motor vehicles.

The invention claimed is:

1. A heat exchanger comprising:

a refrigerant inlet header having a refrigerant inlet and positioned in a downstream side of a direction of air flow;

a refrigerant outlet header positioned in an upstream side of the direction of air flow and having a refrigerant outlet; and a refrigerant circulating passage for causing the inlet header to communicate with the outlet header therethrough, the circulating passage comprising at least two intermediate headers and a plurality of heat exchange tubes for causing the inlet header and the outlet header to communicate with all the intermediate headers therethrough, the intermediate headers including a refrigerant inflow intermediate header and a refrigerant outflow intermediate header juxtaposed in an upstream-downstream direction of air flow, the inflow intermediate header and the outflow intermediate header being held in communication at one end of the inflow intermediate header, wherein a heat exchange core comprises tube groups in a plurality of rows arranged in the upstream-downstream direction, each of the tube groups comprising the plurality of heat exchange tubes arranged at a spacing, the refrigerant inlet header positioned toward one end of each of the heat exchange tubes and having joined thereto the heat exchange tubes of one tube group of at least one row, the refrigerant outlet header positioned toward said one end of each heat exchange tube and having joined thereto the heat exchange tubes of the other tube group, the refrigerant inflow intermediate header positioned toward the other end of each heat exchange tube and having jointed thereto the heat exchange tubes joined to the inlet header, and the refrigerant outflow intermediate header positioned toward said other end of each heat exchange tube and in the upstream side and having joined thereto the heat exchange tubes joined to the outlet header, wherein the outflow intermediate header is provided in interior thereof with first flow dividing control means for causing a refrigerant to dividedly flow into the heat exchange tubes joined to the outflow intermediate header uniformly, the first flow dividing control means comprises a first flow dividing control wall having a plurality of refrigerant passing holes for dividing the interior of the outflow intermediate header into first and second spaces arranged one above the other, the inflow intermediate header and the first space of the outflow intermediate header being held in communication at one end of the inflow intermediate header header, and the heat exchange tubes joined to the outflow intermediate header communicate with the second space, wherein the refrigerant passing holes formed in the first flow dividing control wall are arranged at a spacing longitudinally thereof, and the refrigerant passing holes are formed in a portion of the first flow dividing control wall to the upstream side of a midportion thereof with respect to the upstream-downstream direction.

2. A heat exchanger according to claim 1 wherein the heat exchange tubes are flat and are arranged with a width of the heat exchange tubes pointing toward the upstream-downstream direction and are 0.75 to 1.5 mm in height which is in a thickness of the heat exchange tubes.

3. A heat exchanger according to claim 2 wherein a fin is disposed between each adjacent pair of heat exchange tubes and is a corrugated fin comprising crest portions, furrow portions and flat connecting portions each interconnecting the crest portion and the furrow portion, the fin being 7.0 to 10.0 mm in height which is in a straight distance from the crest portion to the furrow portion and 1.3 to 1.7 mm in fin pin which is in a pitch of the connecting portions.

4. A heat exchanger according to claim 3 wherein the crest portion and the furrow portion of the corrugated fin each comprise a flat portion and a rounded portion provided at each of opposite sides of the flat portion and integral with the connecting portion, the rounded portion being up to 0.7 mm in radius of curvature.

5. A refrigeration cycle comprising a compressor, a condenser and an evaporator, the evaporator comprising a heat exchanger according to claim 1.

6. A vehicle having installed therein a refrigeration cycle according to claim 5 as an air conditioner.

7. A heat exchanger according to claim 1 wherein the spacing between each adjacent pair of refrigerant passing holes gradually increases as the control wall extends away from said one end of the inflow intermediate header where the inflow intermediate header and the outflow intermediate header are held in communication.

8. A heat exchanger according to claim 1 wherein respective adjacent pairs of refrigerant passing holes are equal in spacing.

9. A heat exchanger comprising:

a refrigerant inlet header having a refrigerant inlet and positioned in a downstream side of a direction of air flow;

a refrigerant outlet header positioned in an upstream side of the direction of air flow and having a refrigerant outlet; and a refrigerant circulating passage for causing the inlet header to communicate with the outlet header therethrough, the circulating passage comprising at least two intermediate headers and a plurality of heat exchange tubes for causing the inlet header and the outlet header to communicate with all the intermediate headers therethrough, the intermediate headers including a refrigerant inflow intermediate header and a refrigerant outflow intermediate header juxtaposed in an upstream-downstream direction of air flow, the inflow intermediate header and the outflow intermediate header being held in communication at one end of the inflow intermediate header, wherein a heat exchange core comprises tube groups in a plurality of rows arranged in the upstream-downstream direction, each of the tube groups comprising the plurality of heat exchange tubes arranged at a spacing, the refrigerant inlet header positioned toward one end of each of the heat exchange tubes and having joined thereto the heat exchange tubes of one tube group of at least one row, the refrigerant outlet header positioned toward said one end of each heat exchange tube and having joined thereto the heat exchange tubes of the other tube group, the refrigerant inflow intermediate header positioned toward the other end of each heat exchange tube and having jointed thereto the heat exchange tubes joined to the inlet header, and the refrigerant outflow intermediate header positioned toward said other end of each heat exchange tube and in the upstream side and having joined thereto the heat exchange tubes joined to the outlet header, wherein the outflow intermediate header is provided in interior thereof with first flow dividing control means for causing a refrigerant to dividedly flow into the heat exchange tubes joined to the outflow intermediate header uniformly, the first flow dividing control means comprises a first flow dividing control wall having a plurality of refrigerant passing holes for dividing the interior of the outflow intermediate header into first and second spaces arranged one above the other, the inflow intermediate header and the first space of the outflow intermediate header being held in communication at one end of the inflow intermediate header header, and the heat exchange tubes joined to the outflow intermediate header communicate with the second space, wherein the inflow intermediate header and the outflow intermediate header are provided by dividing a refrigerant turn tank into a front and a rear portion by separating means, and the turn tank is provided at one end thereof with a communication member for holding the inflow intermediate header and the outflow intermediate header in communication therethrough.

10. A heat exchanger according to claim 9 wherein the heat exchange tubes are flat and are arranged with a width of the heat exchange tubes pointing toward the upstream-downstream direction and are 0.75 to 1.5 mm in height which is in a thickness of the heat exchange tubes.

11. A heat exchanger according to claim 10 wherein a fin is disposed between each adjacent pair of heat exchange tubes and is a corrugated fin comprising crest portions, furrow portions and flat connecting portions each interconnecting the crest portion and the furrow portion, the fin being 7.0 to 10.0 mm in height which is in a straight distance from the crest portion to the furrow portion and 1.3 to 1.7 mm in fin pin which is in a pitch of the connecting portions.

12. A heat exchanger according to claim 11 wherein the crest portion and the furrow portion of the corrugated fin each comprise a flat portion and a rounded portion provided at each of opposite sides of the flat portion and integral with the connecting portion, the rounded portion being up to 0.7 mm in radius of curvature.

13. A refrigeration cycle comprising a compressor, a condenser and an evaporator, the evaporator comprising a heat exchanger according to claim 9.

14. A vehicle having installed therein a refrigeration cycle according to claim 13 as an air conditioner.

15. A heat exchanger comprising:

a refrigerant inlet header having a refrigerant inlet and positioned in a downstream side of a direction of air flow;

a refrigerant outlet header positioned in an upstream side of the direction of air flow and having a refrigerant outlet; and a refrigerant circulating passage for causing the inlet header to communicate with the outlet header therethrough, the circulating passage comprising at least two intermediate headers and a plurality of heat exchange tubes for causing the inlet header and the outlet header to communicate with all the intermediate headers therethrough, the intermediate headers including a refrigerant inflow intermediate header and a refrigerant outflow intermediate header juxtaposed in an upstream-downstream direction of air flow, the inflow intermediate header and the outflow intermediate header being held in communication at one end of the inflow intermediate header, wherein a heat exchange core comprises tube groups in a plurality of rows arranged in the upstream-downstream direction, each of the tube groups comprising the plurality of heat exchange tubes arranged at a spacing, the refrigerant inlet header positioned toward one end of each of the heat exchange tubes and having joined thereto the heat exchange tubes of one tube group of at least one row, the refrigerant outlet header positioned toward said one end of each heat exchange tube and having joined thereto the heat exchange tubes of the other tube group, the refrigerant inflow intermediate header positioned toward the other end of each heat exchange tube and having jointed thereto the heat exchange tubes joined to the inlet header, and the refrigerant outflow intermediate header positioned toward said other end of each heat exchange tube and in the upstream side and having joined thereto the heat exchange tubes joined to the outlet header, wherein the outflow intermediate header is provided in interior thereof with first flow dividing control means for causing a refrigerant to dividedly flow into the heat exchange tubes joined to the outflow intermediate header uniformly, the first flow dividing control means comprises a first flow dividing control wall having a plurality of refrigerant passing holes for dividing the interior of the outflow intermediate header into first and second spaces arranged one above the other, the inflow intermediate header and the first space of the outflow intermediate header being held in communication at one end of the inflow intermediate header header, and the heat exchange tubes joined to the outflow intermediate header communicate with the second space, wherein the inflow intermediate header and the outflow intermediate header are provided by dividing a refrigerant turn tank into a front and a rear portion by separating means, and the turn tank comprises a first member having the heat exchange tubes joined thereto, a second member brazed to the first member at a portion thereof opposite to the heat exchange tubes, and two closing members brazed to respective opposite ends of the first and second members, the second member being integrally provided with the separating means and the first flow dividing control wall, wherein one of the closing members has two through holes for respectively causing the inflow intermediate header and the first space of the outflow intermediate header in communication with the inflow intermediate header to communicate with outside therethrough, and is provided with a communication member brazed to an outer side thereof for holding the two through holes in communication therethrough.

16. A heat exchanger according to claim 15 wherein the closing member having the through holes is platelike and the communication member is a plate having the same shape and size as the platelike closing member when seen from one side, the communication member being provided with an outwardly bulging portion having an inside communication channel for holding the two through holes of the closing member in communication therethrough.

17. A heat exchanger according to claim 16 wherein the closing member having the through holes comprises a main body having a contour shaped in conformity with the cross sectional contour of the turn tank and a protrusion projecting from the main body toward the inlet header and the outlet header, and the outwardly bulging portion of the communication member is formed in corresponding relation with the main body and the protrusion of the closing member.

18. A heat exchanger according to claim 15 wherein the heat exchange tubes are flat and are arranged with a width of the heat exchange tubes pointing toward the upstream-downstream direction and are 0.75 to 1.5 mm in height which is in a thickness of the heat exchange tubes.

19. A heat exchanger according to claim 18 wherein a fin is disposed between each adjacent pair of heat exchange tubes and is a corrugated fin comprising crest portions, furrow portions and flat connecting portions each interconnecting the crest portion and the furrow portion, the fin being 7.0 to 10.0 mm in height which is in a straight distance from the crest portion to the furrow portion and 1.3 to 1.7 mm in fin pin which is in a pitch of the connecting portions.

20. A heat exchanger according to claim 19 wherein the crest portion and the furrow portion of the corrugated fin each comprise a flat portion and a rounded portion provided at each of opposite sides of the flat portion and integral with the connecting portion, the rounded portion being up to 0.7 mm in radius of curvature.

21. A refrigeration cycle comprising a compressor, a condenser and an evaporator, the evaporator comprising a heat exchanger according to claim 15.

22. A vehicle having installed therein a refrigeration cycle according to claim 21 as an air conditioner.

23. A heat exchanger comprising:

a refrigerant inlet header having a refrigerant inlet and positioned in a downstream side of a direction of air flow;

a refrigerant outlet header positioned in an upstream side of the direction of air flow and having a refrigerant outlet; and a refrigerant circulating passage for causing the inlet header to communicate with the outlet header therethrough, the circulating passage comprising at least two intermediate headers and a plurality of heat exchange tubes for causing the inlet header and the outlet header to communicate with all the intermediate headers therethrough, the intermediate headers including a refrigerant inflow intermediate header and a refrigerant outflow intermediate header juxtaposed in an upstream-downstream direction of air flow, the inflow intermediate header and the outflow intermediate header being held in communication at one end of the inflow intermediate header, wherein a heat exchange core comprises tube groups in a plurality of rows arranged in the upstream-downstream direction, each of the tube groups comprising the plurality of heat exchange tubes arranged at a spacing, the refrigerant inlet header positioned toward one end of each of the heat exchange tubes and having joined thereto the heat exchange tubes of one tube group of at least one row, the refrigerant outlet header positioned toward said one end of each heat exchange tube and having joined thereto the heat exchange tubes of the other tube group, the refrigerant inflow intermediate header positioned toward the other end of each heat exchange tube and having jointed thereto the heat exchange tubes joined to the inlet header, and the refrigerant outflow intermediate header positioned toward said other end of each heat exchange tube and in the upstream side and having joined thereto the heat exchange tubes joined to the outlet header, wherein the outflow intermediate header is provided in interior thereof with first flow dividing control means for causing a refrigerant to dividedly flow into the heat exchange tubes joined to the outflow intermediate header uniformly, wherein the inlet header is provided in interior thereof with second flow dividing control means for causing the refrigerant to dividedly flow into the heat exchange tubes joined to the inlet header uniformly, wherein the second flow dividing control means comprises a second flow dividing control wall having a plurality of refrigerant passing holes for dividing the interior of the inlet header into first and second two spaces arranged one above the other, the refrigerant inlet being in communication with the first space, and the heat exchange tubes joined to the inlet header communicate with the second space, wherein the refrigerant passing holes formed in the second flow dividing control wall are arranged at a spacing longitudinally thereof and are smaller than the refrigerant passing holes in the first flow dividing control means.

24. A heat exchanger according to claim 23 wherein the outlet header is provided in interior thereof with third flow dividing control means for causing the refrigerant to dividedly flow into the heat exchange tubes joined to the outlet header uniformly.

25. A heat exchanger according to claim 24 wherein the third flow dividing control means comprises a third flow dividing control wall having refrigerant passing holes for dividing the interior of the outlet header into first and second two spaces arranged one above the other, the refrigerant outlet being in communication with the first space, and the heat exchange tubes joined to the outlet header communicate with the second space.

26. A heat exchanger according to claim 23 wherein the inlet header and the outlet header are provided by dividing a refrigerant inlet-outlet tank into a front and a rear portion by separating means.

27. A heat exchanger according to claim 26 wherein the inlet-outlet tank comprises a first member having the heat exchange tubes joined thereto, a second member brazed to the first member at a portion thereof opposite to the heat exchange tubes, and two closing members brazed to respective opposite ends of the first and second members, the second member being integrally provided with the separating means, the second flow dividing control wall, and a third flow dividing wall having refrigerant passing holes for dividing the interior of the outlet header into two spaces arranged one above the other.

28. A heat exchanger according to claim 23 wherein the heat exchange tubes are flat and are arranged with a width of the heat exchange tubes pointing toward the upstream-downstream direction and are 0.75 to 1.5 mm in height which is in a thickness of the heat exchange tubes.

29. A heat exchanger according to claim 28 wherein a fin is disposed between each adjacent pair of heat exchange tubes and is a corrugated fin comprising crest portions, furrow portions and flat connecting portions each interconnecting the crest portion and the furrow portion, the fin being 7.0 to 10.0 mm in height which is in a straight distance from the crest portion to the furrow portion and 1.3 to 1.7 mm in fin pin which is in a pitch of the connecting portions.

30. A heat exchanger according to claim 29 wherein the crest portion and the furrow portion of the corrugated fin each comprise a flat portion and a rounded portion provided at each of opposite sides of the flat portion and integral with the connecting portion, the rounded portion being up to 0.7 mm in radius of curvature.

31. A refrigeration cycle comprising a compressor, a condenser and an evaporator, the evaporator comprising a heat exchanger according to claim 23.

32. A vehicle having installed therein a refrigeration cycle according to claim 31 as an air conditioner.

* * * * *